US007081906B2

(12) United States Patent
Kim et al.

(10) Patent No.: US 7,081,906 B2
(45) Date of Patent: Jul. 25, 2006

(54) DRIVING METHOD AND DEVICE FOR FLAT PANEL DISPLAY

(75) Inventors: Hwan Yu Kim, Euwang-si (KR); Byung Soo Song, Goyang-si (KR)

(73) Assignee: LG Electronics Inc., Seoul (KR)

( * ) Notice: Subject to any disclaimer, the term of this patent is extended or adjusted under 35 U.S.C. 154(b) by 198 days.

(21) Appl. No.: 10/329,382

(22) Filed: Dec. 27, 2002

(65) Prior Publication Data

US 2003/0151565 A1 Aug. 14, 2003

(30) Foreign Application Priority Data

| | | |
|---|---|---|
| Dec. 27, 2001 | (KR) | 2001-86010 |
| Mar. 9, 2002 | (KR) | 2002-12686 |
| May 9, 2002 | (KR) | 2002-25552 |
| May 11, 2002 | (KR) | 2002-26047 |
| May 11, 2002 | (KR) | 2002-26048 |
| May 31, 2002 | (KR) | 2002-30603 |

(51) Int. Cl.
*G09G 5/10* (2006.01)

(52) U.S. Cl. ..... 345/690; 345/63; 345/77; 345/88; 345/89

(58) Field of Classification Search ..... 345/60–72, 345/88, 89, 690–694, 77; 348/671–674, 348/700; 382/265–273; 358/3.06–3.22
See application file for complete search history.

(56) References Cited

U.S. PATENT DOCUMENTS

| | | | | |
|---|---|---|---|---|
| 4,999,711 | A * | 3/1991 | Paulin | 348/672 |
| 5,546,101 | A * | 8/1996 | Sugawara | 345/63 |
| 5,568,571 | A * | 10/1996 | Willis et al. | 382/254 |
| 6,400,346 | B1 * | 6/2002 | Kasahara et al. | 345/63 |
| 6,414,657 | B1 * | 7/2002 | Kasahara et al. | 345/63 |
| 6,529,211 | B1 * | 3/2003 | Ohara et al. | 345/690 |
| 2005/0237277 | A1 * | 10/2005 | Kawahara | 345/63 |

* cited by examiner

*Primary Examiner*—Alexander Eisen
(74) *Attorney, Agent, or Firm*—Fleshner & Kim, LLP

(57) ABSTRACT

The present invention relates to a driving device for a flat panel display and driving method of, capable of enhancing an image quality. In the present invention, a gray level of an original image is rearranged using the minimal distribution lower and upper gray levels determined using a histogram. The present invention provides the means to solve an excessive change of color that can be generated when rearranging the gray level of the original image, an image display deterioration due to the low gray level area and a saturation of the high gray level area.

27 Claims, 29 Drawing Sheets

FIG. 27

| (A) | (B) | (C) |
|---|---|---|
| 0 | 0.0000 | 0 |
| 5 | 0.0203 | 0.0102 |
| 5.818182 | 0.0293 | 0.0248 |
| 6.636364 | 0.0401 | 0.0347 |
| 7.454545 | 0.0530 | 0.0466 |
| 8.272727 | 0.0681 | 0.0606 |
| 9.090909 | 0.0854 | 0.0768 |
| 9.909091 | 0.1050 | 0.0952 |
| 10.72727 | 0.1271 | 0.1160 |
| 11.54545 | 0.1516 | 0.1393 |
| 12.36364 | 0.1786 | 0.1651 |
| 13.18182 | 0.2083 | 0.1935 |
| 14 | 0.2407 | 0.2245 |
| 14.81818 | 0.2759 | 0.2583 |
| 15.63636 | 0.3139 | 0.2949 |
| 16.45455 | 0.3548 | 0.3343 |
| 17.27273 | 0.3986 | 0.3767 |
| 18.09091 | 0.4454 | 0.4220 |
| 18.90909 | 0.4953 | 0.4703 |
| 19.72727 | 0.5483 | 0.5218 |
| 20.54545 | 0.6045 | 0.5764 |
| 21.36364 | 0.6638 | 0.6341 |
| 22.18182 | 0.7265 | 0.6952 |
| 23 | 0.7925 | 0.7595 |
| 24 | 0.8777 | 0.8777 |
| 25 | 0.9681 | 0.9681 |
| 26 | 1.0636 | 1.0636 |
| 27 | 1.1644 | 1.1644 |
| 28 | 1.2706 | 1.2706 |
| 29 | 1.3823 | 1.3823 |
| 30 | 1.4995 | 1.4995 |

DRIVING METHOD AND DEVICE FOR FLAT PANEL DISPLAY

BACKGROUND OF THE INVENTION

1. Field of the Invention

The present invention relates to a flat panel display, and more particularly, to a driving method and device for a flat panel display, capable of enhancing picture quality by improving contrast of image during the display of the image.

2. Discussion of the Related Art

There have been actively developed flat panel displays, such as Liquid Crystal Display (LCD), Field Emission Display (FED) and Plasma Display Panel (PDP), which can display images on screens.

In a PDP, an ultraviolet ray generated by gas discharge excites a phosphor to generate a visible ray. The PDP displays images by using the visible ray. The PDP is thinner and lighter than a CRT that has been mainly used. The PDP is advantageous to an implementation of high fidelity and large-sized screen. Generally, a PDP includes of a plurality of discharge cells arranged in a matrix configuration. One discharge cell represents one pixel in a screen.

FIG. 1 illustrates a frame including eight subfields in a driving method for a conventional plasma display panel. As shown in FIG. 1, a frame includes several subfields (for example, eight subfields) the discharge numbers of which are different from each other in order to represent a gray level of an image. Each of subfields has a reset period to remove wall charge of an entire cell uniformly, an address period to form wall charge in cells of a specific position, and a sustain period to represent an image on a screen by representing the gray level according to the discharge number. The discharge number of each subfield is classified by eight bits. For example, in order to set the brightness of some specific cell to be level of 112, fifth, sixth and seventh subfields SF5, SF6 and SF7 are addressed and subsequently discharges occur at the corresponding subfields by $2^4$, $2^5$ and $2^6$ times respectively. Accordingly, the sum of the discharge numbers achieves the emission brightness of level of 112. Here, the sustain period is increased at each subfield by the ratio of $2^n$ (n=0, 1, 2, 3, 4, 5, 6, 7) while the reset period and the address period are the same at each subfield.

FIG. 2 illustrates structure of a conventional PDP driving device. Referring to FIG. 2, the conventional PDP driving device includes a frame memory 2 and an image processor 4, which are connected between an input line 1 and panel 6, and the image processor 4 includes a gamma correction unit 8, a gain control unit 10, an error propagation unit 12, a subfield mapping unit 14, a data sorting unit 16, an APL arithmetic unit 18 and a waveform generation unit 20.

The frame memory 2 stores an original image inputted from the input line 1 frame by frame and supplies the gamma correction unit 8 with the stored original image.

The gamma correction unit 8 performs an inverse gamma correction based on the original image inputted from the frame memory 2 and linearly transforms the ratio of the gray level of an output image to the gray level of the original image.

The gain control unit 10 converts the gray level range of the output image transformed linearly by the gamma correction unit 8 into a predetermined gray level range.

The error propagation unit 12 propagates the cell's the error components generated from the image outputted from the gain control unit 10 to neighboring cells. This allows a user to finely adjust a brightness value.

Brightness weights for subfields are in advance assigned to the subfield mapping unit 14. Accordingly, the subfield mapping unit 14 maps data to corresponding subfields according to the gray level of the original image passing through the error propagation unit 12.

The data sorting unit 16 transforms the data mapped to the subfield mapping unit 14 to be suitable for the resolution format of the PDP and supplies the transformed data to an address driving IC of the panel 6.

Meanwhile, the APL arithmetic unit 18 finds an average picture level (APL) for the output image transformed linearly by the gamma correction unit 8 and generates a signal of level N corresponding to the number of sustain pulses based on the APL. The waveform generator 20 generates a timing control signal according to the signal of level N generated by the APL arithmetic unit 18 and supplies the timing control signal to an address driving IC, a scan driving IC and a sustain driving IC of the panel 6. Here, the address driving IC, the scan driving IC and the sustain driving IC are connected to an address electrode, a scan electrode and a sustain electrode of the panel 6, respectively, which is not shown in FIG. 2.

Since the PDP configured as above displays the gray level of the original image on a screen without any process, it is impossible to obtain a clear image. Especially, in case of a moving image, an improvement in a picture quality cannot be expected. For example, according to the PDP driving device shown in FIG. 2, the minimal distribution lower gray level (MIN) and the maximal distribution lower gray level (MAX) are set to be 0 and 255, respectively. In this case, a dynamic range cannot be adjusted in response to the gray level change of the original image. Here, the dynamic range is the range between the minimal distribution lower gray level (MIN) and the maximal distribution lower gray level (MAX) of the original image or the gray level variation range.

As mentioned above, in case that the dynamic range cannot be adjusted in response to the gray level change of the original image, the original image cannot be displayed perfectly. And also, even though the picture quality is improved by adjusting the dynamic range using the minimal distribution lower gray level (MIN) and the maximal distribution lower gray level (MAX), following problems may occur.

First, colors may change too far from the original image in comparison with the original image in a signal processing for adjusting a dynamic range.

Second, as a result of the dynamic range adjustment, the original images moved to a dark portion deteriorates due to a low gray level which displays the image on a screen without any expression.

Third, as a result of the dynamic range adjustment, the original image the gray level of which is equal to or greater than the minimal distribution upper gray level (MAX) is converted into 255 gray levels so that the expression of the bright image deteriorates.

On the other hand, a gray level of an output signal of flat panel displays such as an LCD, an FED and a PDP is not shown linearly with respect to that of an input signal so that the original image is displayed differently according to inherent input/output characteristic of the flat panel displays. Today, each of the flat panel displays performs an inverse correction to correct gray level so as to be suitable for its own displaying characteristic.

FIG. 3 illustrates a gray level correction using a fixed gamma curve in a conventional CRT. The CRT nonlinearly displays an output gray level with respect to an input gray level. This is due to the inherent input/output characteristics of the CRT itself. Accordingly, image media such as broadcast systems obtain and transmit an image using a gamma curve as shown in FIG. 1 so as to linearly display an input/output gray level of the CRT. Consequently, the input/output gamma curve in the form of a straight line is made due to the inherent input/output characteristic of the CRT.

Unlike the CRT, the flat panel display shows the inherent input/output characteristic in the form of a straight line. Since the images obtained by broadcast systems are, however, transmitted in a nonlinear form, the flat panel display is forced to correct the input/output characteristic of the gray level to be linear through an inverse gamma correction.

As described above, the flat display device as well as the CRT applies the fixed gamma curve to all images across the board. If the fixed gamma curve is applied to all images across the board, contrast in all images may be deteriorated. Since the slope of the gamma curve approaches to zero especially at a low brightness gray level, an image quality may deteriorate very seriously due to round off error at the low brightness gray level.

As a result, if the same gamma curve is applied to all images, the desired contrast is not obtained and therefore image display quality is also degraded.

SUMMARY OF THE INVENTION

Accordingly, the present invention is directed to a driving device for a flat panel display and driving method of the same that substantially obviates one or more problems due to limitations and, disadvantages of the related art.

An object of the present invention is to provide a driving method and device for a flat panel display, capable of improving a picture quality by moving a middle gray level to lower and upper gray levels.

Another object of the present invention is to provide a driving method and device for a flat panel display, capable of improving picture quality by adjusting dynamic range.

Another object of the present invention is to provide a driving method and device for a flat panel display, capable of correcting an excessive change of color generated when adjusting the dynamic range.

A further object of the present invention is to provide a driving method and device for a flat panel display, capable of controlling the deterioration of the low gray level area generated when adjusting the dynamic range.

Still another object of the present invention is to provide a driving method and device for a flat panel display, capable of correcting the saturation generated when adjusting the dynamic range.

Further still another object of the present invention is to provide a driving method and device for a flat panel display, capable of selecting a gamma curve suitable for each image and correcting the gray level.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving method for a flat panel display and a driving device using the same comprises the steps of: (a) removing a predetermined gray level area from an original image using a histogram; and (b) rearranging the original image using the remaining gray level areas except the removed gray level area.

In another aspect of the present invention, a driving method for a flat panel display and the driving device using the same comprises the steps of: (a) determining minimal distribution lower and upper gray levels of an original image using a histogram; and (b) rearranging the original image using the minimal distribution lower and upper gray levels.

The minimal distribution lower and upper gray levels are determined by the histogram distribution ratio calculated from the histogram. A gray level range of the original image is expanded using gray levels existing between the minimal distribution lower and upper gray levels.

In another aspect of the present invention, a driving method for a flat panel display and the driving device using the same comprises the steps of: (a) determining minimal distribution lower and upper gray levels of an original image using a histogram; (b) calculating a motion amount using the original image and a one frame-delayed original image; and (c) rearranging a gray level of the one frame-delayed original image using the motion amount and the minimal distribution lower and upper gray levels.

The motion amount is calculated by comparing same points of the original image with the one frame-delayed original image.

In another aspect of the present invention, a driving method for a flat panel display and the driving device using the same comprises the steps of: (a) determining minimal distribution lower and upper gray levels of an original image using a histogram; (b) calculating a motion amount using the original image and a one frame-delayed original image; (c) detecting a same gray level distribution degree of an original image; (d) re-determining the minimal distribution lower and upper gray levels using the motion amount and the same gray level distribution; and (e) rearranging a gray level of the one frame-delayed original image using the minimal distribution lower and upper gray levels.

The minimal distribution lower and upper gray levels are re-determined using a first weight set based on the motion amount and second weight set based on the same gray level distribution degree.

In another aspect of the present invention, a driving method for a flat panel display and the driving device using the same comprises the steps of: (a) calculating a motion amount using the original image and a one frame-delayed original image; (b) determining minimal distribution lower and upper gray levels using a histogram; (c) determining whether the minimal distribution lower gray level is equal to or greater than an expressible critical value; and (d) rearranging a gray level of the one frame-delayed original image using a modified gamma table when the minimal distribution lower gray level is equal to or greater than the expressible critical value.

The modified gamma table includes a predetermined modified low gray level area. Inverse gamma correction is performed by adjusting brightness of a gray level of the rearranged original image.

In another aspect of the present invention, a driving method for a flat panel display and the driving device using the same comprises the steps of: (a) determining minimal distribution lower and upper gray levels using a histogram; (b) rearranging a one frame-delayed original image using gray levels existing between the minimal distribution lower and upper gray levels; (c) performing a gamma correction to generate an output gray level on a gray level of the rearranged original image; and (d) applying to a gamma output curve, a peak compensation value determined according to comparison of a gamma compensated output gray level with an output gray level of a predetermined period delayed original image from the one frame-delayed original image.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 27 illustrates a brightness value adjusted by a brightness adjustment unit shown in FIG. 26;

DETAILED DESCRIPTION OF THE INVENTION

Reference will now be made in detail to the preferred embodiments of the present invention, examples of which are illustrated in the accompanying drawings. The present invention changes a gray level of the original image to brighten a bright image and darken a dark image so that a contrast is improved. Wherever possible, the same reference numbers shown in FIG. 2 will be used throughout the drawings to refer to the same or like parts. The repeated description of the components shown in FIG. 2 will be intentionally omitted.

Figure 4:
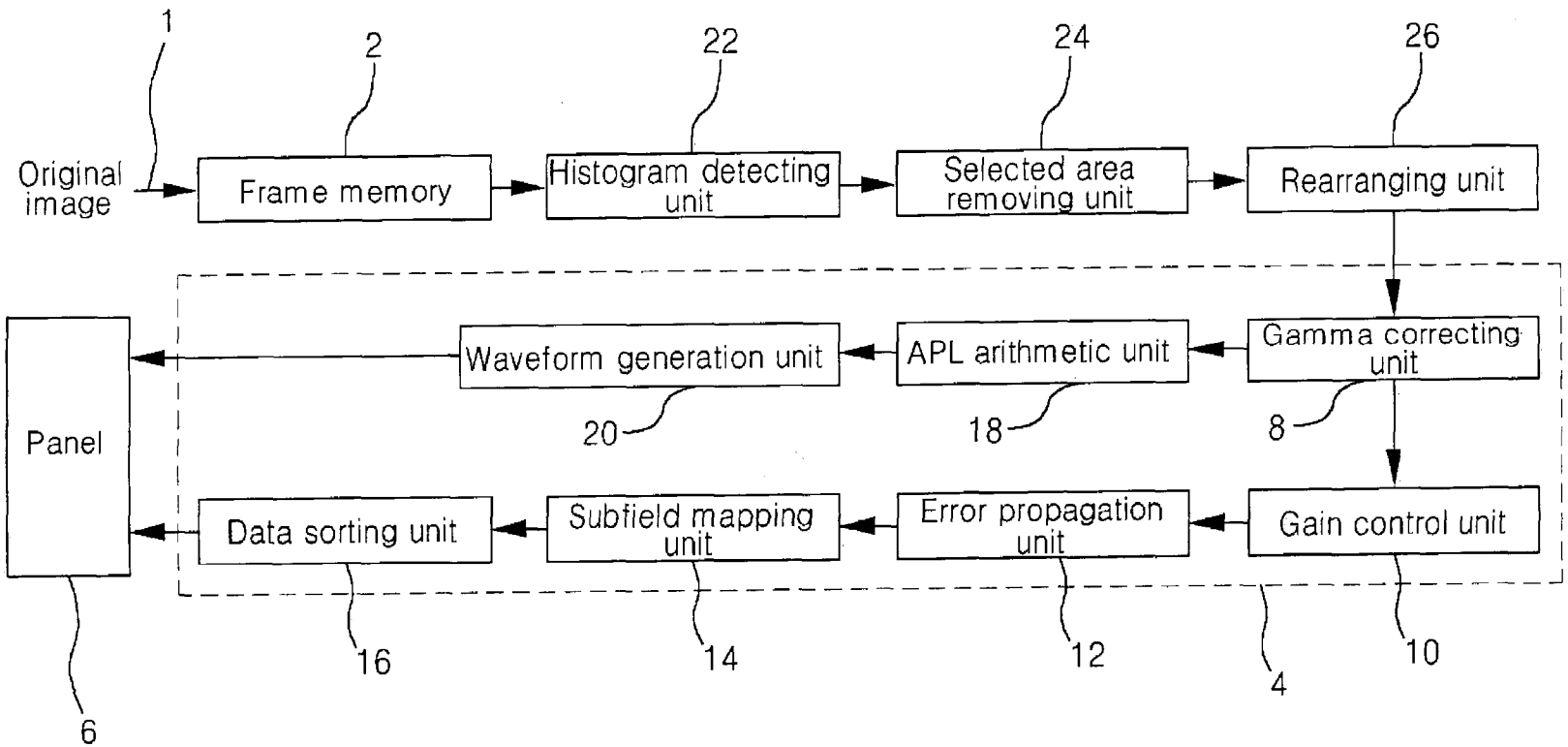
FIG. 4 illustrates a PDP diving device including the whole idea of the present invention.

FIG. 4 illustrates a PDP diving device including the whole idea of the present invention. Referring to FIG. 4, the PDP driving device includes a frame memory 2, a histogram detecting unit 22, a selected area removing unit 24, a rearranging unit 26 and an image processing unit 4, which are connected between an input line 1 and a panel 6. An original image inputted from the input line 1 is stored in the frame memory 2 frame by frame. The histogram detecting unit 22 detects a histogram for the original image outputted from the frame memory 2 frame by frame.

Figure 5:
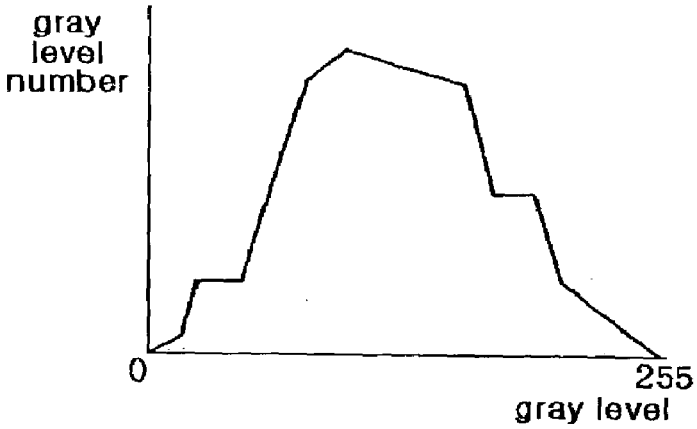
FIGS. 5 through 7 illustrate an image processing method using a histogram.

In other words, the histogram detecting unit 22 finds a histogram distribution number for each gray level of the original image as shown in FIG. 5. The selected area removing unit 24 removes some gray level area based on the histogram number. In other words, the first critical value and the second critical value of the selected area removing unit 24 are set. When an entire gray level area is classified into a lower area, a middle area and an upper area, the first critical value is set for the lower gray level area and the second critical value is set for the upper gray level area.

Figure 6:
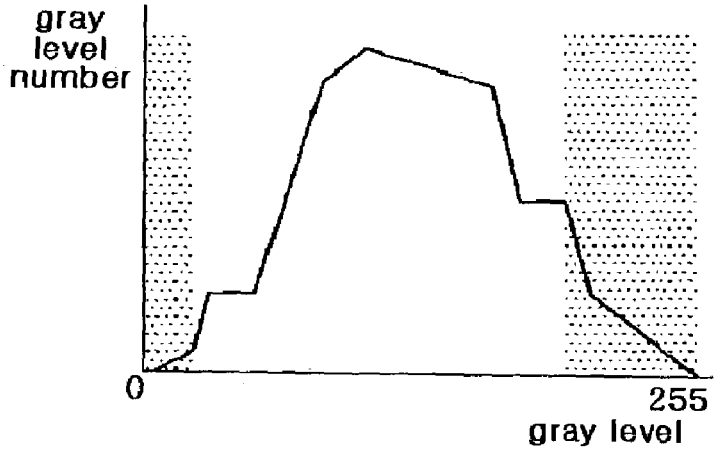

As shown in FIG. 6, the selected area removing unit 24 compares a histogram distribution number of each gray level of lower gray level area with the first critical value and selects an area from the gray level corresponding to a histogram distribution number corresponding to the first critical value to the gray level 0 as a predetermined gray level area to be removed. Similarly, the selected area removing unit 24 compares a histogram distribution number of each gray level of the upper gray level area with the second critical value and selects an area from the gray level corresponding to a histogram distribution number corresponding to the second critical value to the gray level of 255 as a predetermined gray level area to be removed. Otherwise, the selected area removing unit 24 does not use the first critical value and the second critical value but may apply a single critical value and select the lower gray level area and the upper gray level area as a predetermined gray level area to be removed.

Figure 1:
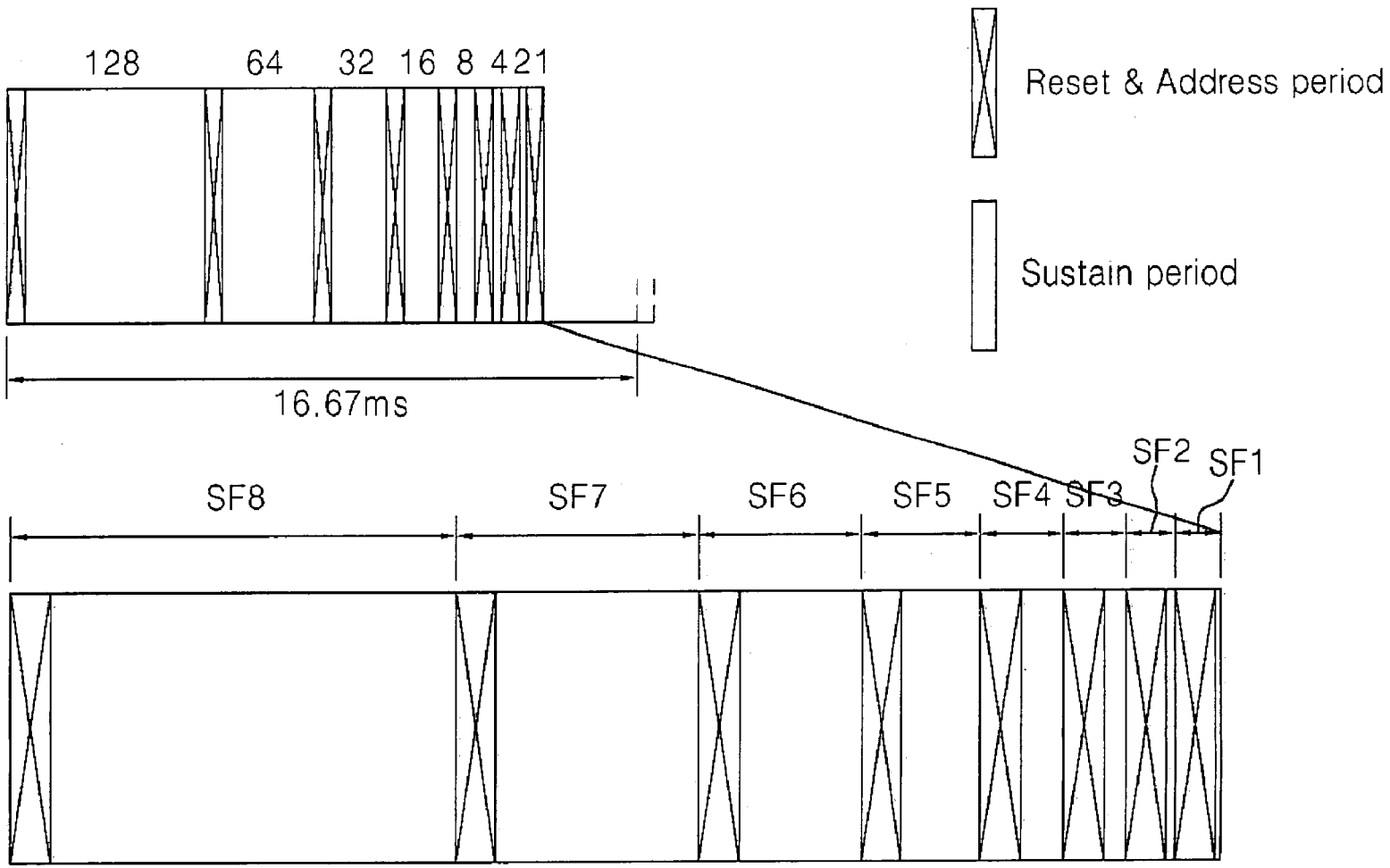
FIG. 1 illustrates a frame including eight subfields in driving method for a conventional plasma display panel.
Figure 2:
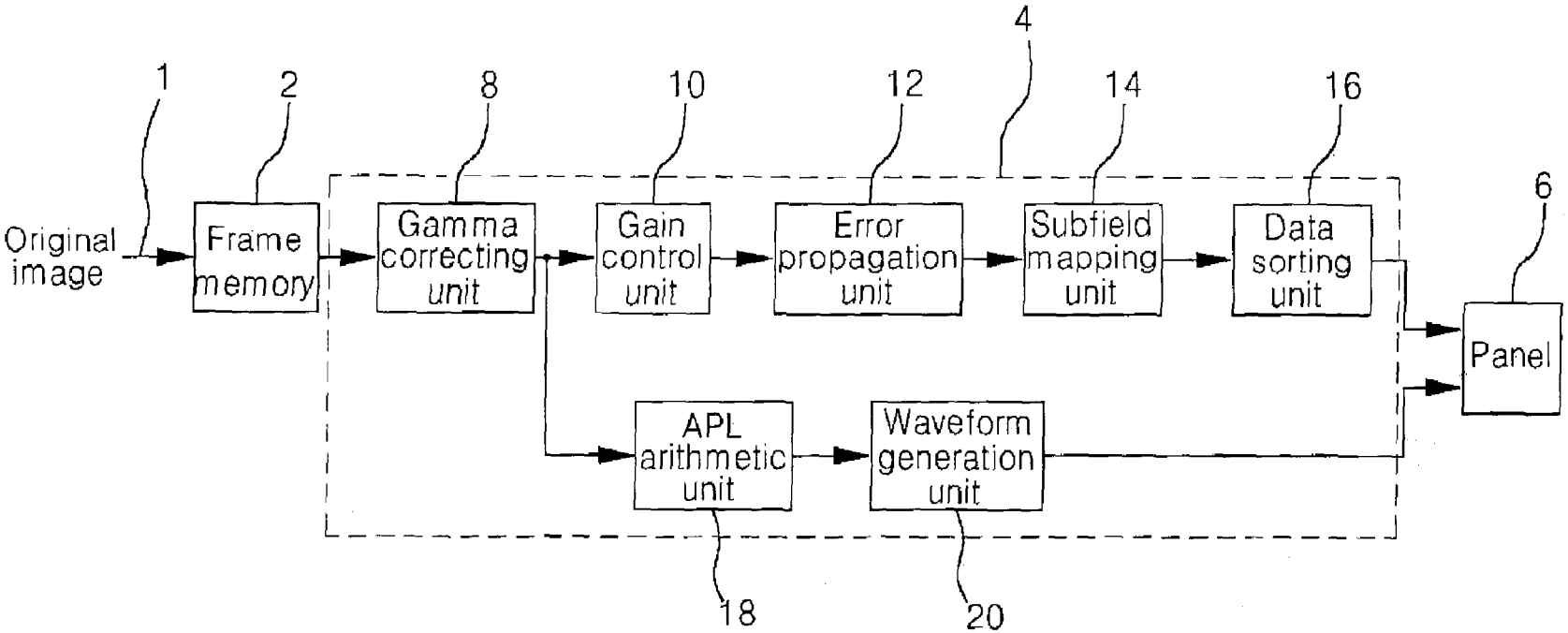
FIG. 2 illustrates a structure of a conventional PDP driving device.
Figure 3:
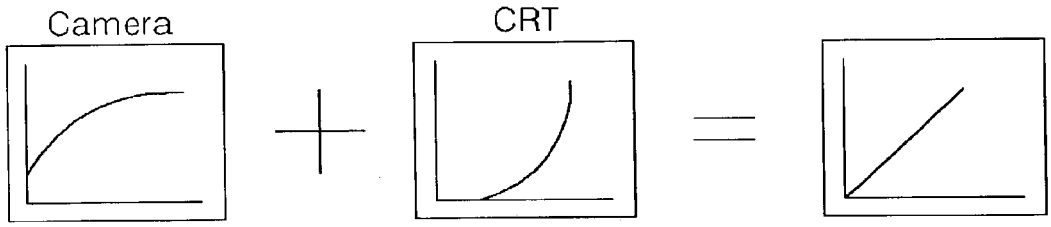
FIG. 3 illustrates a correction of a gray level using a fixed gamma curve in a conventional CRT.
Figure 7:
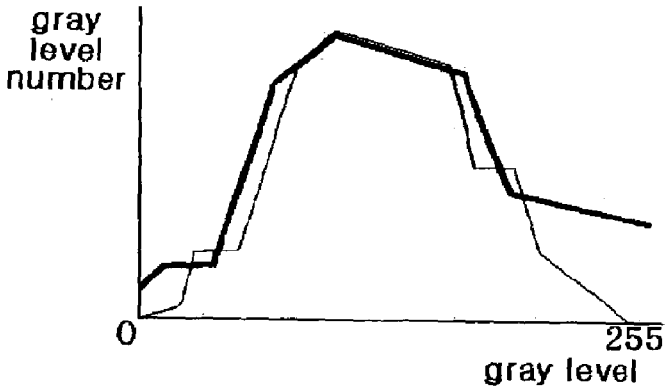

As shown in FIG. 7, the rearranging unit 26 rearranges the original image using the gray level area that is not removed by the selected area removing unit 24. In this case, the gray level that is not removed is rearranged uniformly for the entire range of the gray level of 0 to the gray level of 255. Here, it is noted that a histogram distribution number distributed for the original gray level is maintained to be the same even though the gray level that is not removed is rearranged for the entire range. The image processing unit 4 processes the rearranged original image to display it on a panel as shown in FIG. 2. The image processing unit 4 shown in FIG. 2 will not be disclosed since the description of the image processing unit 4 shown in FIG. 1 was. made.

According to the present invention configured as above, after a predetermined gray level area that has a low histogram distribution number is removed, the remaining gray level areas are rearranged for the entire range of the gray level while maintaining the histogram distribution number, so that a bright area gets brighter and a dark area gets darker. This leads to an improvement of contrast of a screen so that a clearer display image is provided.

The more detailed description of the basic technical idea of the present invention is made using various embodiments.

Figure 8:
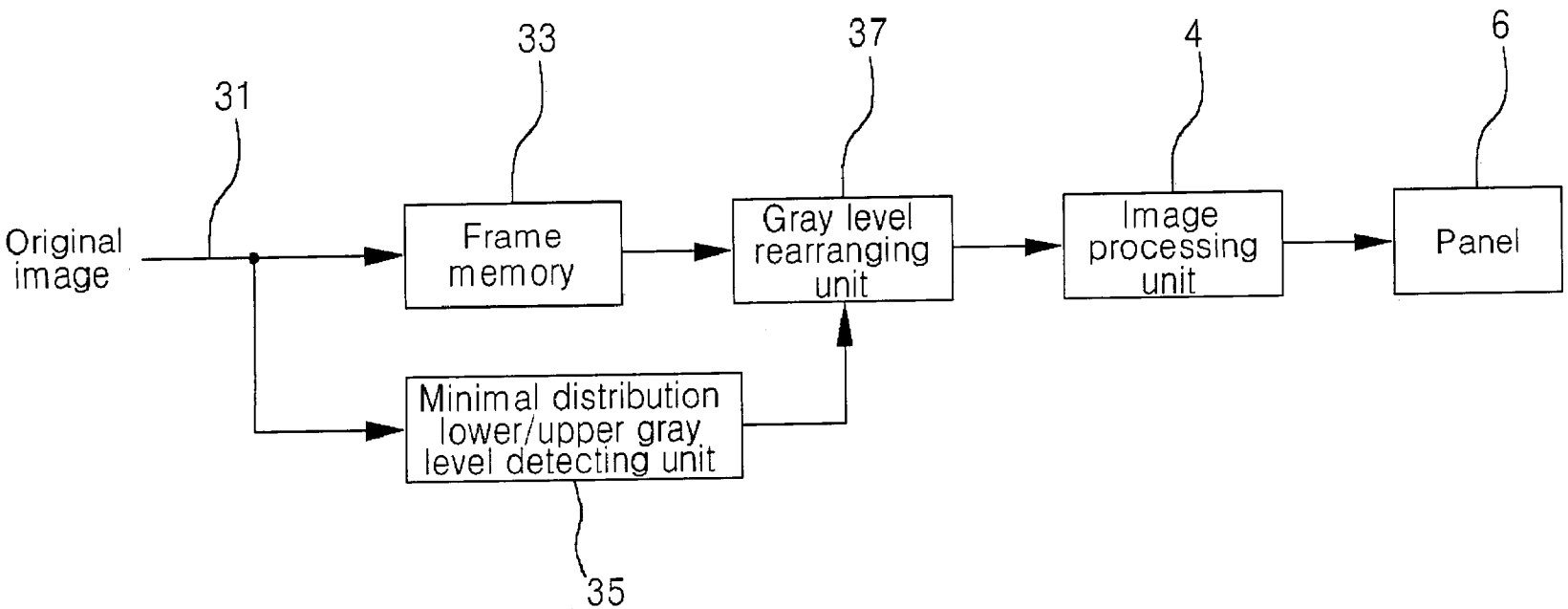
FIG. 8 illustrates a PDP driving device according to a first preferred embodiment of the present invention.

FIG. 8 illustrates a PDP driving device according to a first preferred embodiment of the present invention. Referring to FIG. 8, the PDP driving device comprises a frame memory 33, a minimal distribution lower/upper gray level detecting unit 35, a gray level rearranging unit 37 and an image processing unit 4, which are connected between an input line 31 and panel 6. Here, the description of the image processing unit 4 is omitted since the image processing unit 4 is the same as described above. An original image inputted from the input line 31 is supplied to the frame memory 33 and the minimal distribution lower/upper gray level detecting unit 35. The frame memory 33 is connected between an input line 31 and the gray level rearranging unit 37, temporarily stores the original image of one frame and supplies it to the gray level rearranging unit 37. The minimal distribution lower/upper gray levels detecting unit 35 is connected between the input line 31 and the gray level rearranging unit 37 in parallel to the frame memory 33 to calculate a histogram distribution ratio for the gray level in some range for the original image. In other words, the minimal distribution lower/upper gray levels detecting unit 35 calculates a histogram distribution number for the gray level in some range among the entire gray levels of the original image. Here, it is desired that the gray level in the range be of gray level of 0 to 20 and gray level of 220 to 255. Of course, referring to the histogram distribution number of each gray level, the gray level in some range may be changed.

Using the calculated histogram distribution number and resolution, the histogram distribution number is calculated. In other words, the histogram distribution ratio Hist[1] is represented as Expression 1.

$$\text{histogram distribusion ratio} = \frac{\text{histogram distribution number}}{\text{resolution}} * 100 \qquad \text{Expression 1}$$

As shown in Expression 1, the histogram distribution ratio is represented as a percentage of histogram distribution number of each gray level divided by resolution. For example, when a histogram distribution number of the gray level of 2 of the PDP having WVGA (853*480) resolution mode is 245, the histogram distribution ratio Hist[2] is represented as follows:

$$Hist[2] = \frac{245}{853 * 480} * 100 = 0.06\%.$$

The histogram distribution ratios for the gray level of 0 to 20 and the gray level of 220 to 255 are calculated as Table 1 and Table 2.

TABLE 1

| Histogram | Distribution ratio (%) |
|---|---|
| Hist [0] | 0.02 |
| Hist [1] | 0.04 |
| Hist [2] | 0.06 |
| Hist [3] | 0.0 |
| . . . | . . . |
| Hist [17] | 0.03 |
| Hist [18] | 0.09 |
| Hist [19] | 0.1 |
| Hist [20] | 1 |

TABLE 2

| Histogram | Distribution ratio (%) |
|---|---|
| Hist [220] | 1.0 |
| Hist [221] | 0.1 |
| Hist [222] | 0.06 |
| Hist [223] | 0.001 |
| . . . | . . . |
| Hist [252] | 0.03 |
| Hist [253] | 0.02 |
| Hist [254] | 0.09 |
| Hist [255] | 0.05 |

Here, the histogram distribution ratios for the gray level in some range depend on the original image inputted for one frame.

The minimal distribution lower/upper gray levels detecting unit 35 applies a preset reference histogram distribution ratio to the histogram distribution ratios for the gray level in the range to determine the minimal distribution lower gray level (MIN) and the minimal distribution upper gray level (MAX). For example, if a preset reference histogram distribution ratio is set to be 0.1%, this 0.1% is applied to Tables 1 and 2 to determine the minimal distribution lower/upper gray levels of 19 and 221 respectively.

First, it is ascertained whether the histogram distribution ratio for each gray level corresponding to 0 to 20 is 0.1%. In other words, it is ascertained whether the histogram distribution ratio for a gray level of 0 is 0.1%. If it is ascertained that the histogram distribution ratio for the gray level of 0 is 0.1%, the gray level of 0 in accord with the histogram distribution ratio of 0.1% is determined to be the minimal distribution gray level. If it is ascertained that the histogram distribution ratio for the gray level of 0 is not 0.1%, it is ascertained whether the histogram distribution ratio for the next gray level of 1 is 0.1%. The minimal distribution lower gray level is determined through such a processing.

Next, it is ascertained whether the histogram distribution ratio for each gray level corresponding to 220 to 255 is 0.1%. In other words, it is ascertained whether the histogram distribution ratio for a gray level of 220 is 0.1%. If it is ascertained that the histogram distribution ratio for the gray level of 220 is 0.1%, the gray level of 220 in accord with the histogram distribution ratio of 0.1% is determined to be the minimal distribution gray level. If it is ascertained that the histogram distribution ratio for the gray level of 220 is not 0.1%, the gray level in accord with the histogram distribution ratio of 0.1% is found continually. The minimal distribution upper gray level is determined through such a processing.

The gray level rearranging unit 37 applies the gray levels between the minimal distribution lower gray level and the minimal distribution upper gray level to Expression 2 based on the minimal distribution lower and upper gray levels (MIN and MAX) determined by the minimal distribution lower and upper gray levels detecting unit 35 to rearrange the original image supplied from the frame memory 33.

$$Y = \frac{X - \mathrm{MIN}}{\mathrm{MAX} - \mathrm{MIN}} * 255 \qquad \text{Expression 2}$$

where X is a gray level between the minimal distribution lower gray level and the minimal distribution upper gray level;

Y is a rearranged gray level;

MIN is the minimal distribution lower gray level; and

MAX is the minimal distribution upper gray level.

For example, when X is 40 and the minimal distribution lower gray level of 19 and the minimal distribution upper gray level of 221 are applied to Expression 2, the gray level of Y rearranged by $$Y = \frac{40 - 19}{221 - 19} * 255$$

is 26.5. Accordingly, a gray level of 40 of the original image is changed to the lower gray level of 26.6. In this case, it is noticed that a histogram distribution ratio for the corresponding gray level is maintained, even though the gray level is changed. As described above, if Expression 2 is applied, the gray levels between the minimal distribution lower gray level and the minimal distribution upper gray level are changed to be lower or higher. Accordingly, the gray levels of the original image existing between 19 and 221 are expanded to the lower gray levels or the higher gray levels so that dark areas get darker and bright areas get brighter. This leads to an improvement of contrast and a clearer image quality is also obtained.

Figure 9:
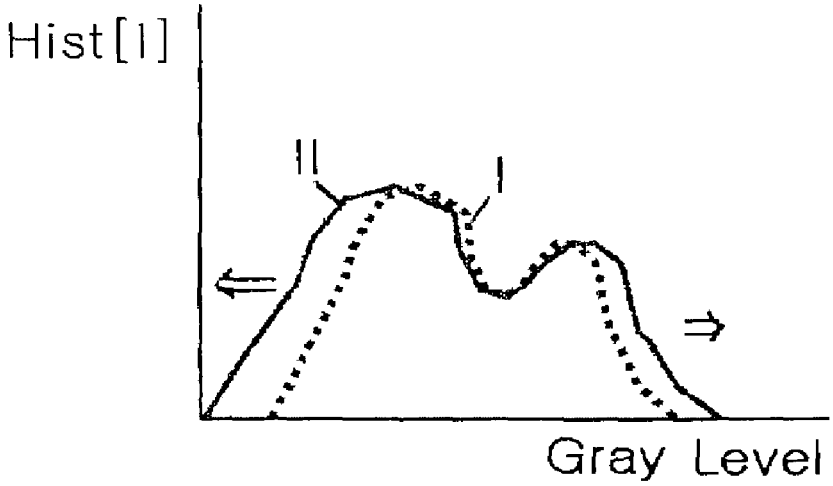
FIG. 9 illustrates a change of the histogram distribution ratio for a gray level in a PDP driving device according to the first preferred embodiment of the present invention.

In the first embodiment, as shown in FIG. 9, a histogram distribution I represented by a dotted line is rearranged to get a histogram distribution II represented by a solid line.

Figure 10:
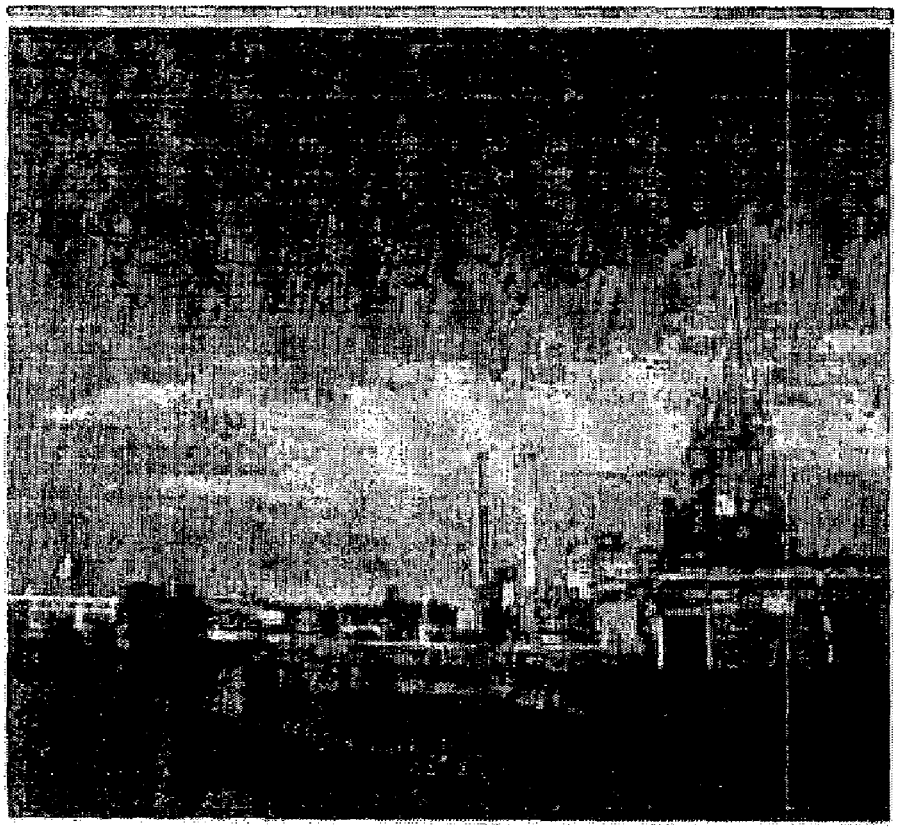
FIGS. 10 and 11 illustrate images according to the first preferred embodiment of the present invention.
Figure 11:
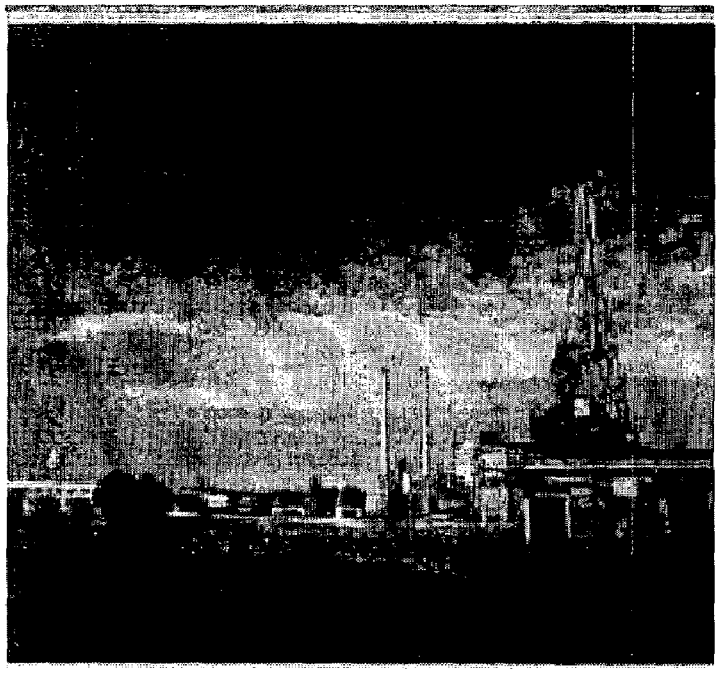

FIG. 10 illustrates images in the related art. FIG. 11 illustrates images according to the first preferred embodiment of the present invention. As shown in FIGS. 10 and 11, the image made by rearranging the original image according to the first embodiment of the present invention is clearer than the image made by the related art.

Figure 12:
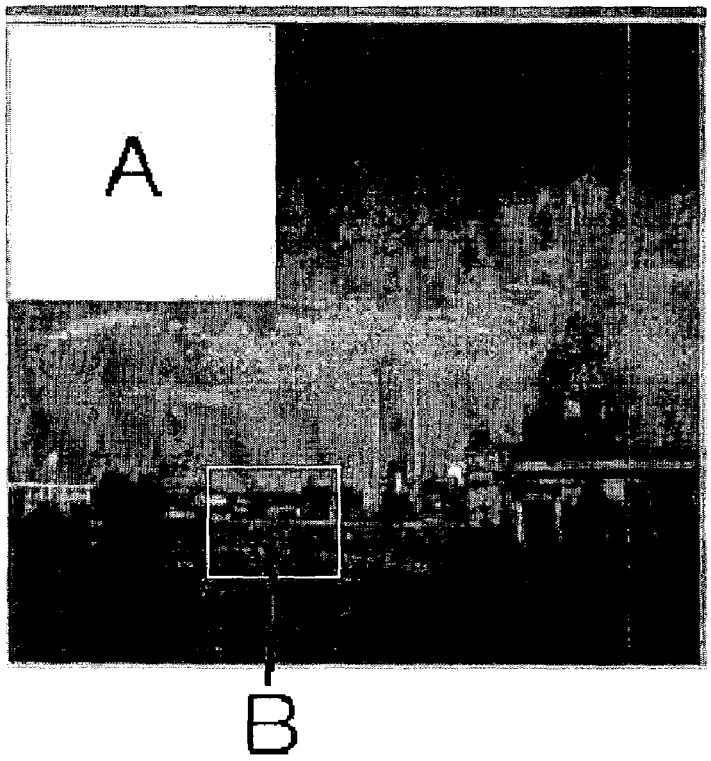
FIG. 12 illustrates selection areas pointed to compare portions of an image.
Figure 13:
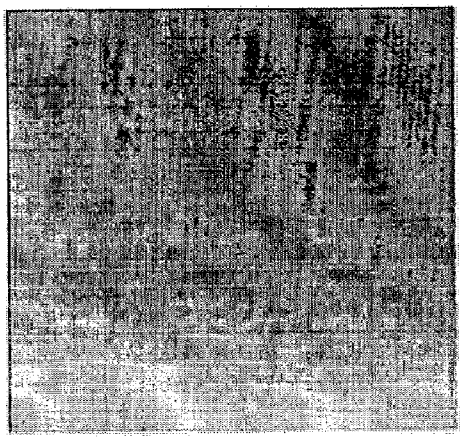
FIGS. 13 and 14 illustrate images of a selection area A of FIG. 12 according to the prior art and the first preferred embodiment of the present invention.
Figure 14:
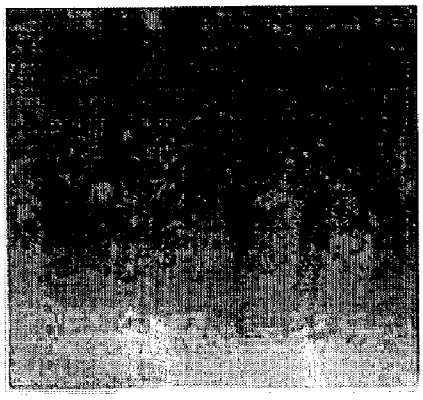
Figure 15:
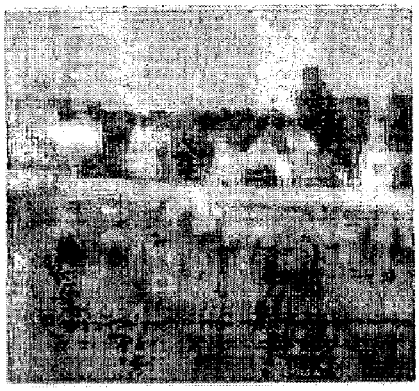
FIGS. 15 and 16 illustrate images of a selection area B of FIG. 12 according to the prior art and the first preferred embodiment of the present invention.
Figure 16:
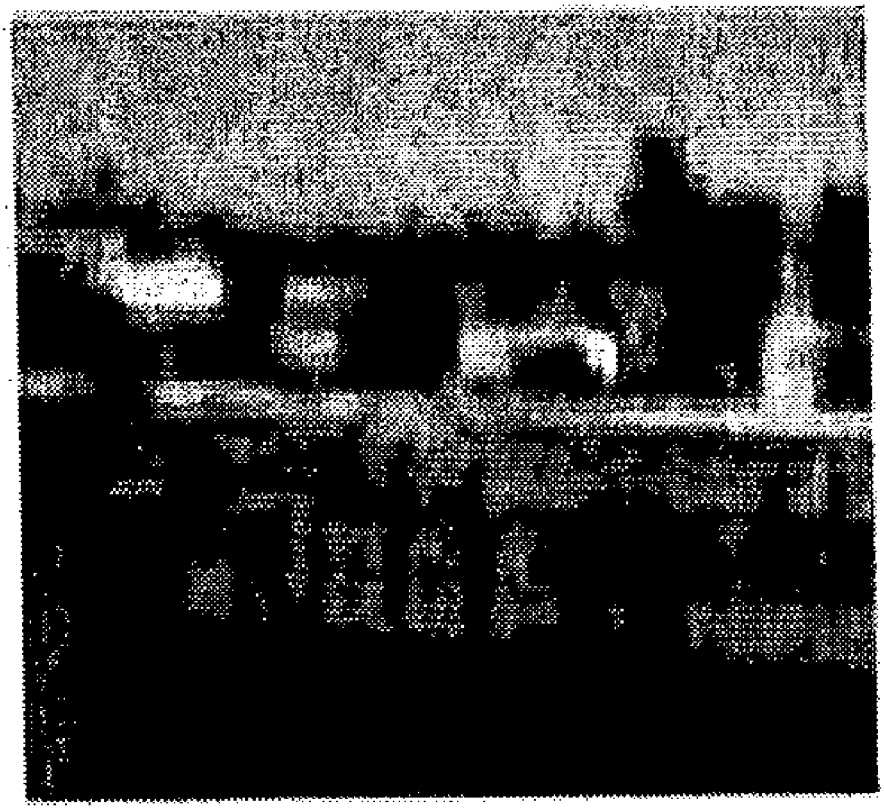

FIG. 12 illustrates selection areas pointed to compare only portions of an image shown in FIG. 10. FIG. 13 illustrates an image according to the prior art on a selection area A of FIG. 12. FIG. 14 illustrates an image according to the first preferred embodiment of the present invention on a selection area A of FIG. 12. FIG. 15 illustrates an image according to the prior art on a selection area B of FIG. 12. FIG. 16 illustrates images according to the first preferred embodiment of the present invention on a selection area B of FIG. 12. It is noted that the dark area of the image belonging to the first embodiment of the present invention is darker than the dark area of the image belonging to the related art. FIGS. 15 and 16 illustrate images that have bright areas and dark areas. In this case, the contrast of the bright area to the dark area is noticeable. It is noted that the contrast is greatly improved.

Figure 17:
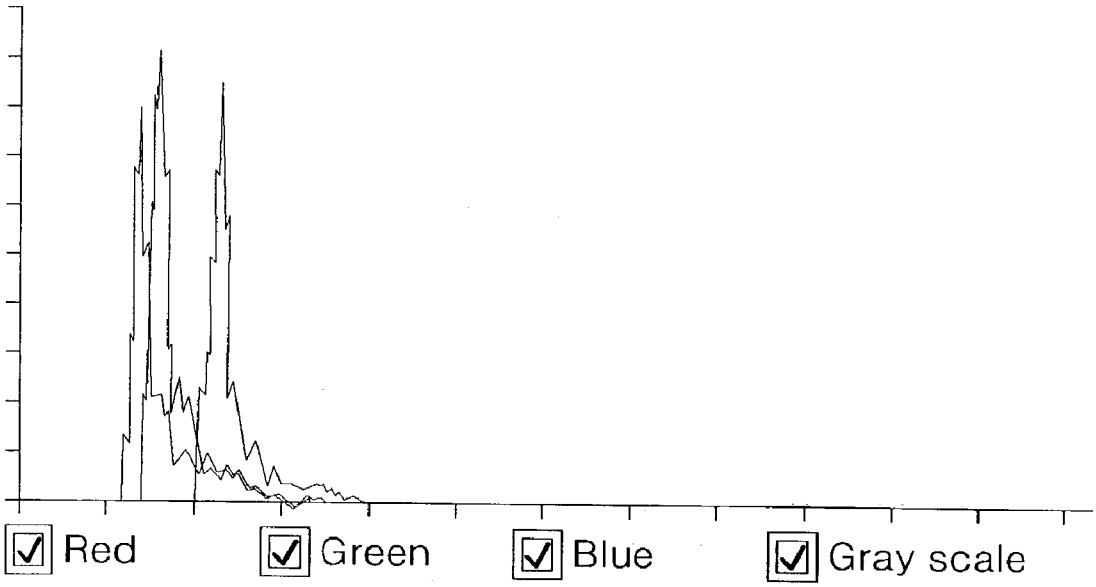
FIGS. 17 and 18 illustrate histogram distribution according to the prior art and the first preferred embodiment of the present invention.
Figure 18:
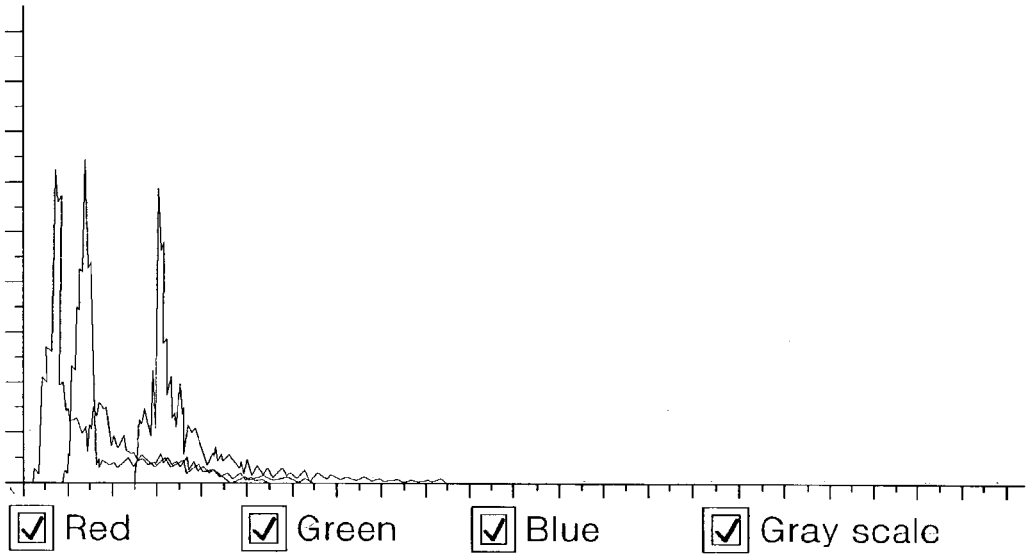

FIG. 17 illustrates histogram distribution according to the prior art. FIG. 18 illustrates histogram distribution according to the first preferred embodiment of the present invention. Referring to FIGS. 17 and 18, it is noted that the histogram distribution according to the first embodiment of the present invention shown in FIG. 18 is shifted to the lower gray level compared with the histogram distribution in the related art shown in FIG. 17 by an expansion of the gray level of the original image according to the minimal distribution lower and upper gray level. Therefore, as described above, the dark portions get darker and the bright portions get brighter so that an entire contrast is improved and the picture quality gets better.

Figure 19:
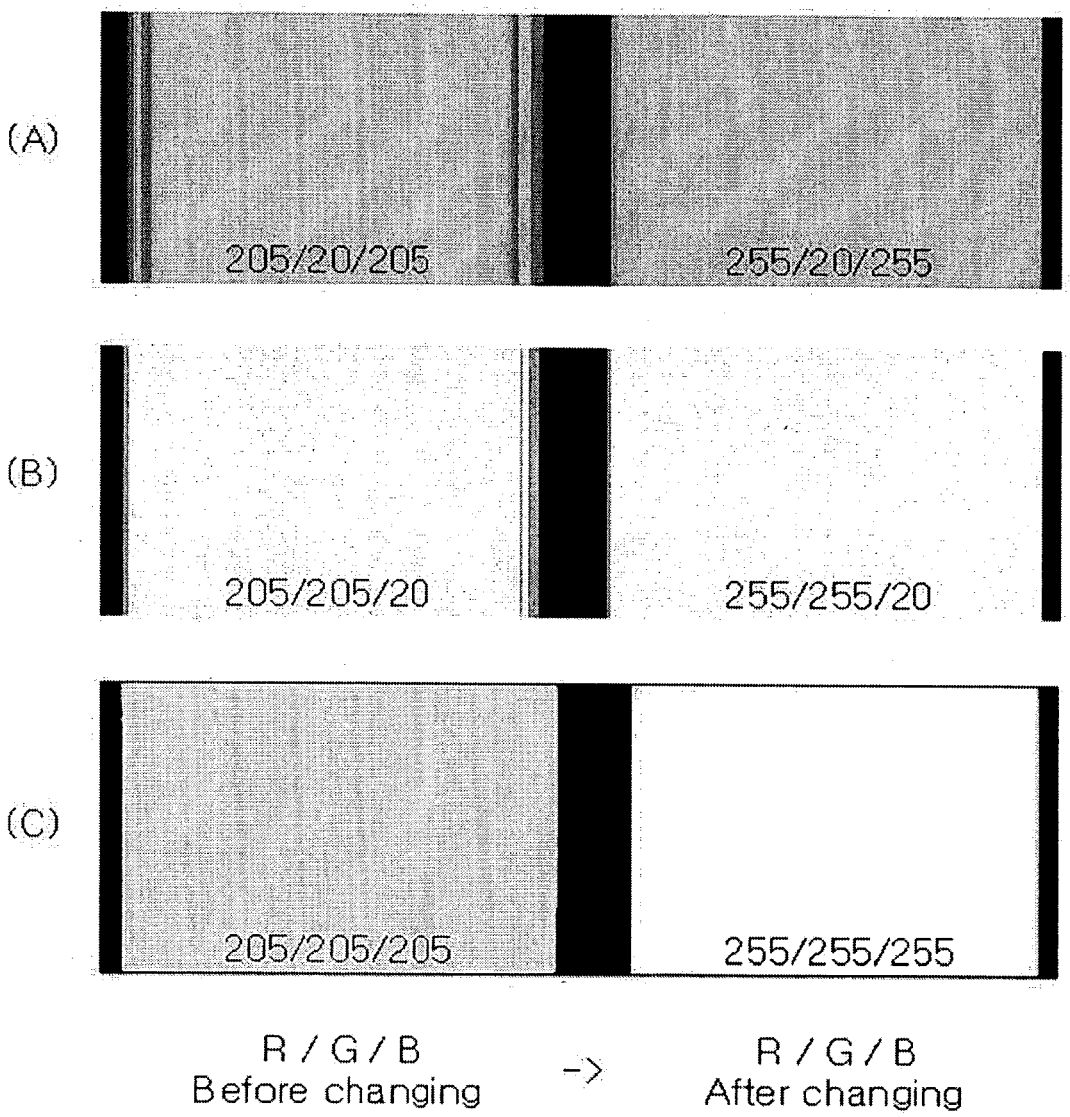
FIG. 19 illustrates a color error conversion when driving a PDP according to the first preferred embodiment of the present invention.

As the description of the first embodiment of the present invention, the gray level of the dark area is changed to be the lower gray level and the gray level of the bright area is changed to be the higher gray level. For example, as shown in FIG. 10, if the gray levels of RGB image area 205, 20, and 205 respectively, the minimal distribution lower gray level and the minimal distribution upper gray level are 20 and 205, respectively. In this case, if the RGB image is applied to Expression 1, the rearranged gray level is 0 or 255. Accordingly, the RGB image on the left of FIG. 19 is transformed to be the rearranged image on the right.

Therefore, as shown in FIG (C), if all the gray level of RGB image is 255, colors are changed too far from the original image as all the gray levels of the rearranged original image are changed to be 255.

Hereinafter, there will be described the preferred embodiments of the present invention to prevent color from being changed.

Figure 20:
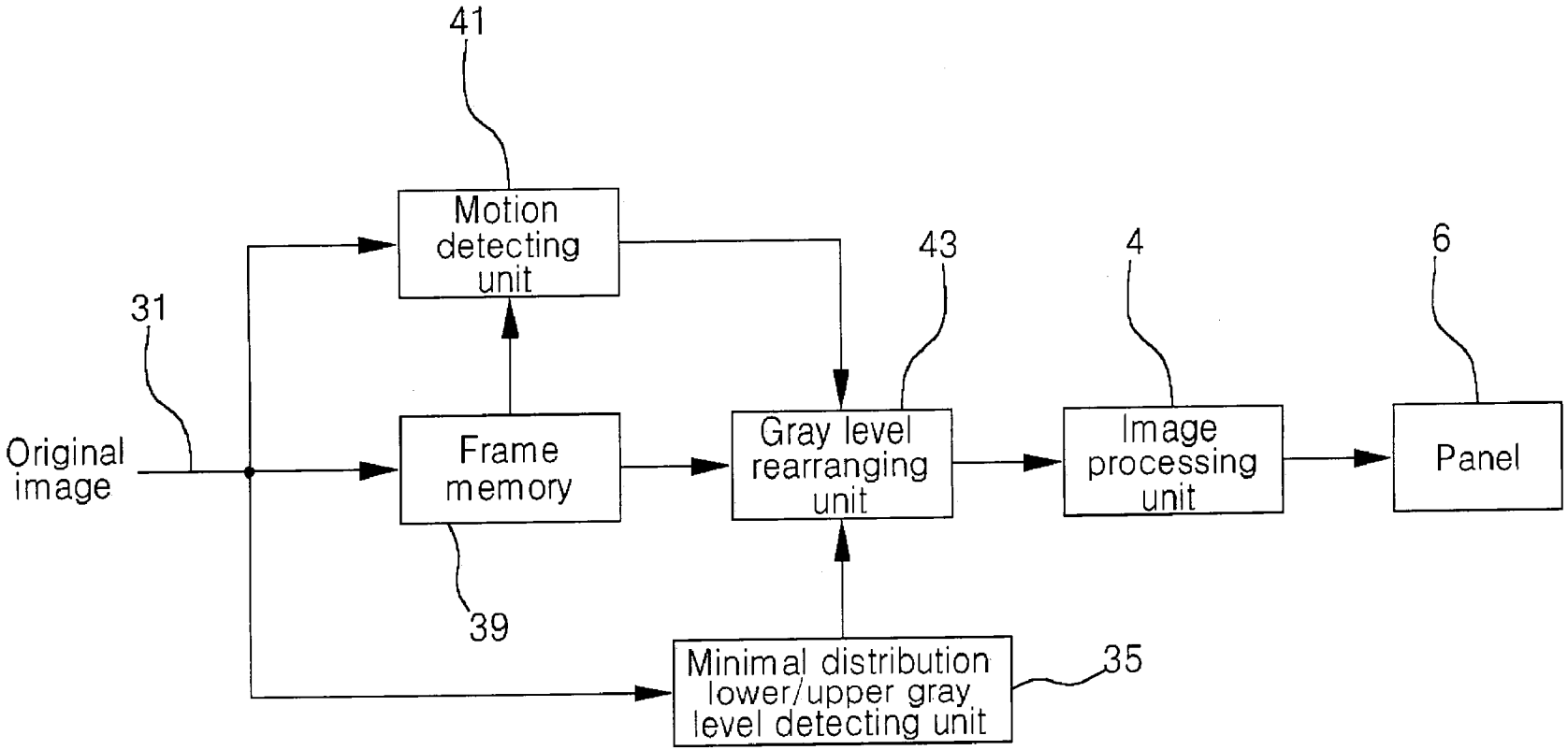
FIG. 20 illustrates an example of a PDP driving device to prevent an excessive color change according to a second preferred embodiment of the present invention.

FIG. 20 illustrates an example of a PDP driving device to prevent an excessive change of color according to a second preferred embodiment of the present invention. Referring to FIG. 20, a PDP driving device according to the second embodiment of the present invention comprises a frame memory 39, a motion detecting unit 41, a minimal distribution lower/upper gray levels detecting unit 35, a gray level rearranging unit 43, an image processing unit 4 and a panel 6. Here, the description of the image processing unit 4 will be omitted since the image processing unit 4 is the same as the previous description. The original image inputted from an input line 31 is provided to the frame memory 39, the motion detecting unit 41 and the minimal distribution lower/upper gray levels detecting unit 35. The frame memory 39 is connected between an input line 31 and the gray level rearranging unit 43, temporarily stores the original image of one frame and supplies it to the gray level rearranging unit 43. The motion detecting unit 41 is connected between the input line 31 and the gray level rearranging unit 43 in parallel to the frame memory 39 to determine a motion degree based on one frame-delayed original image stored previously in the frame memory 39. In other words, the motion detecting unit 41 compares the original image inputted from the input line 31 with one frame-delayed original image stored in the frame memory 39. Here, it is desired that the original image be compared with the one frame-delayed original image at the same positions of them. In other words, as represented in Expression 3, it is ascertained whether the difference between the gray level of the one frame-delayed original image in the frame memory 39 and the gray level of the original image of the input line 31 is equal to or greater than a predetermined critical value.

$$r(x,y)-R(x,y)=T \qquad \text{Expression 3}$$

where x and y are a coordinates of an image;

r(x, y) is a one frame-delayed original image; and

R(x, y) is an original image of an input line.

A motion is detected using Expression 3. For example, when a critical value is 16 and the difference between the gray level of the one frame-delayed original image and the gray level of the original image is equal to or greater than 16, it is determined that a motion occurs. To the contrary, when a critical value is 16 and the difference between the gray level of the one frame-delayed original image and the gray level of the original image is equal to or less than 16, it is determined that a motion does not occur.

As described above, the motion at all the points is detected with respect to all the position of the original image. The motion detecting unit 41 determines how much it moves on a screen based on the information on detected motion at all the position. In the other words, the motion amount of the screen is calculated to generate a motion determination information. For example, if the motion occurs at pixels that occupy more than half screen (or a critical value), it can be determined that the image is a moving image, and otherwise it can be determined that the image is a still image.

Such a motion determination information is supplied to the gray level rearranging unit 43. The gray level rearranging unit 43 is connected to the frame memory 39, the motion detecting unit 41, the minimal distribution lower/upper gray levels detecting unit 35 and the image processing unit 4. The gray level rearranging unit 43 determines whether the one frame-delayed original image outputted from the frame memory 39 is rearranged, based on the motion determination information determined by the motion detecting unit 41. As a result of determination, if the one frame-delayed original image is a still image, the one frame-delayed original image is supplied to the image processing unit 4 as itself.

On the contrary, the gray level rearranging unit 43 rearranges the one frame-delayed original image and sends it to the image processing unit 4 based on the minimal lower/upper gray levels (MIN and MAX) provided by the minimal lower/upper gray levels detecting unit 35 if the one frame-delayed original image is a moving image.

The minimal lower/upper gray levels detecting unit 35 is connected between the input line 31 and the gray level rearranging unit 43 in parallel to the frame memory 39. Here, since the minimal lower/upper gray levels detecting unit 35 is the same as the minimal lower/upper gray levels detecting unit shown in FIG. 8, the related description will be omitted.

In an example of a PDP driving device according to the second embodiment of the present invention having the above-mentioned structure, it is determined whether the original image is a moving image and the gray level of the original image is rearranged so that the an excessive change of color is prevented and the contrast is also improved. So that image can be displayed on a panel clearer.

Figure 21:
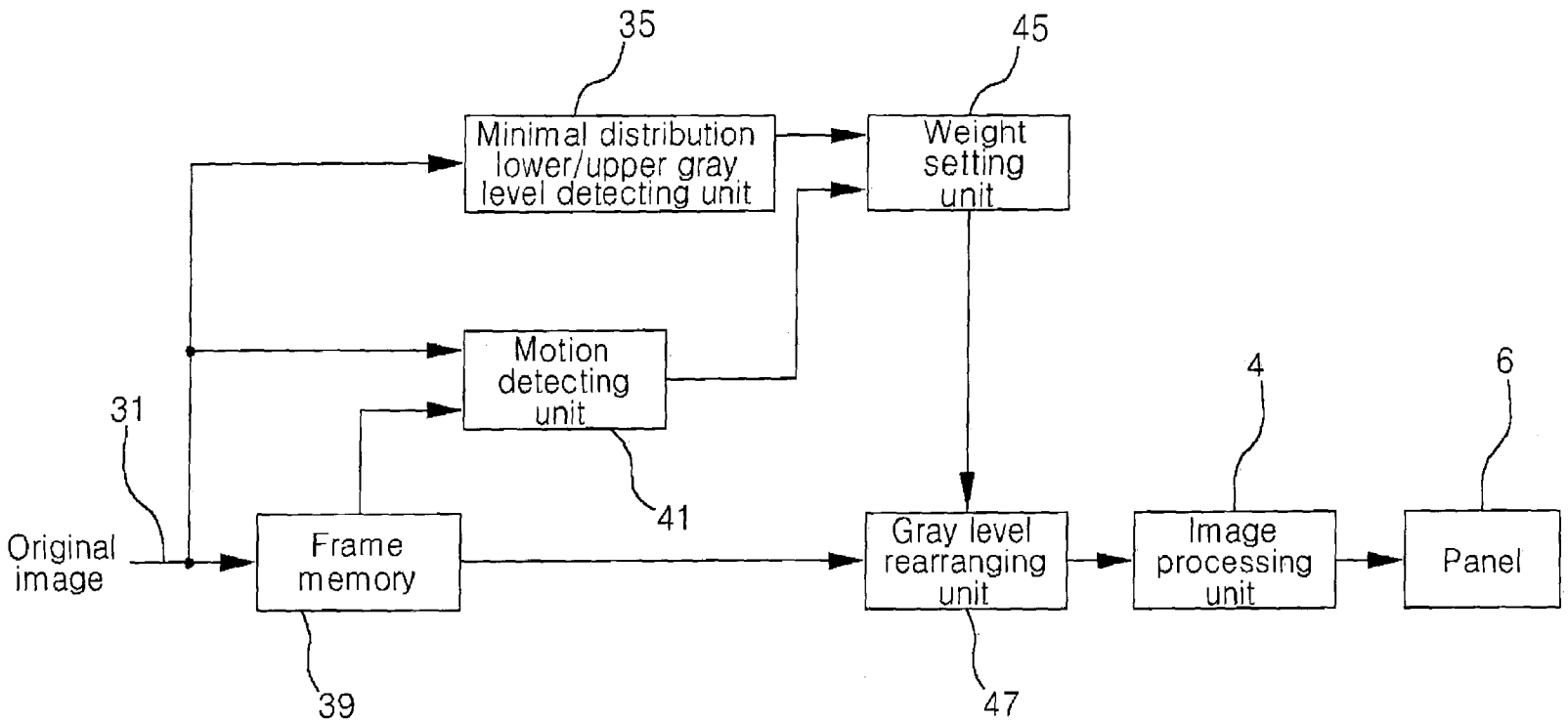
FIG. 21 illustrates another example of a PDP driving device to prevent an excessive color change according to the second preferred embodiment of the present invention.

FIG. 21 illustrates another example of a PDP driving device to prevent an excessive change of color according to the second preferred embodiment of the present invention. Referring to FIG. 21, the PDP driving device includes a frame memory 31, a motion detecting unit 41, a minimal distribution lower/upper gray level detecting unit 35, a weight setting unit 45, a gray level rearranging unit 47, an image processing unit 4 and a panel 6. Here, the description of the image processing unit 4 will be omitted since the image processing unit 4 is the same as the previous description. It is noted that the PDP driving device according to the second embodiment of the present invention shown in FIG. 21 further includes a weight setting unit 45 compared with the PDP driving device according to the second embodiment of the present invention shown in FIG. 20. The original image inputted from an input line 31 is provided to the frame memory 39, the motion detecting unit 41 and the minimal distribution lower/upper gray level detecting unit 35. The frame memory 39 is connected between an input line 31 and the gray level rearranging unit 47, temporarily stores the original image of one frame and supplies it to the motion detecting unit 41 and the gray level rearranging unit 47. The motion detecting unit 41 is connected between the input line 31 and the weight setting unit 45 in parallel to the frame memory 39 to determine whether or not a motion occurs, based on a comparison of one frame-delayed original image stored previously in the frame memory 39 with the original image inputted from the input line 31. Here, the determination of whether or not the motion occurs is performed using the difference between the gray levels of the original images at the same positions. The motion detecting unit 41 determines whether or not there is a motion at respective pixels consisting of one screen, and then calculates a motion degree or a motion amount.

Meanwhile, the minimal distribution lower/upper gray levels detecting unit 35 is connected between the input line 31 and the weight setting unit 45 in parallel to the frame memory 39 to determine the minimal distribution lower/upper gray levels (MIN and MAX) based on the original image inputted from the input line 31. This is the same as the above mention, so the more detailed description will be omitted.

The motion amount calculated by the motion detecting unit 41 and the minimal distribution lower/upper gray levels are supplied to the weight setting unit 45. The weight setting unit 45 is connected to the minimal distribution lower/upper gray level detecting unit 35, the motion detecting unit 41 and the gray level rearranging unit 47, so that the weight is set according to the motion amount. Here, the weight depends on the minimal distribution lower gray level and the minimal distribution upper gray level. In the other words, the weight for the minimal distribution lower gray level is set to be equal to or less than unity and the weight for the minimal distribution upper gray level is set to be equal to or greater than unity.

Therefore, the weight setting unit 45 compares the motion amount supplied from the motion detecting unit 41 with a critical value, and supplies the minimal distribution lower/upper gray levels as itself to the gray level rearranging unit 47 if the motion amount is equal to or less than the critical value. On the contrary, if the motion amount is equal to or greater than the critical value, the minimal distribution lower/upper gray levels are re-determined using the set weight. For example, it is noted that the minimal distribution lower/upper gray levels are respectively set to be 20 and 200 by the minimal distribution lower/upper gray level detecting unit 35 and the weights for the minimal distribution lower/upper gray levels are set to be 0.85 and 1.15 respectively. Here, if it is determined that the motion amount is equal to or less than the critical value, the weight setting unit applies the weight of 1.15 to the minimal distribution lower/upper gray levels of 15 and 200 and determines the new minimal distribution lower/upper gray levels to be 17 and 230. In the other words, if the critical value is equal to or less than the motion amount, the minimal distribution lower gray level of 17 is changed to the new minimal distribution lower gray level of 15 and the minimal distribution upper gray level of 200 is changed to the new minimal distribution upper gray level of 230. Thusly, the minimal distribution lower gray level is changed to the lower gray level and the minimal distribution upper gray level is changed to the higher gray level.

The gray level rearranging unit 47 is connected to the frame memory 39, the weight setting unit 45 and the image processing unit 4, so that the gray level of a one frame delayed image signal supplied from the frame memory 39 is rearranged using the minimal distribution lower/upper gray levels re-determined by the weight setting unit 45.

In the other words, if the motion amount of the weight setting unit 45 is equal to or greater than a critical value, the gray level of a one frame-delayed original image is rearranged using the minimal distribution lower/upper gray levels determined by the minimal distribution lower/upper gray level detecting unit 35. If the motion amount of the weight setting unit 45 is equal to or greater than a critical value, the gray level of a one frame-delayed original image is rearranged using the minimal distribution lower/upper gray levels determined according to the set weight.

As mentioned above, the gray level of the one frame-delayed original image is rearranged using the weight according to the motion amount and the minimal distribution lower/upper gray levels determined by the minimal distribution lower/upper gray level detecting unit 35, so that the variation application amount of entire histogram of image can be changed to prevent an excessive change of color compared with the original image. As a result, according to another example of the PDP driving device of the second embodiment of the present invention, the minimal distribution lower/upper gray levels are re-determined using the weight and the original image is rearranged using the re-determined minimal distribution lower/upper gray levels, so that an excessive change of color is previously prevented in a still image which is very noticeable or an image that moves slightly.

Figure 22:
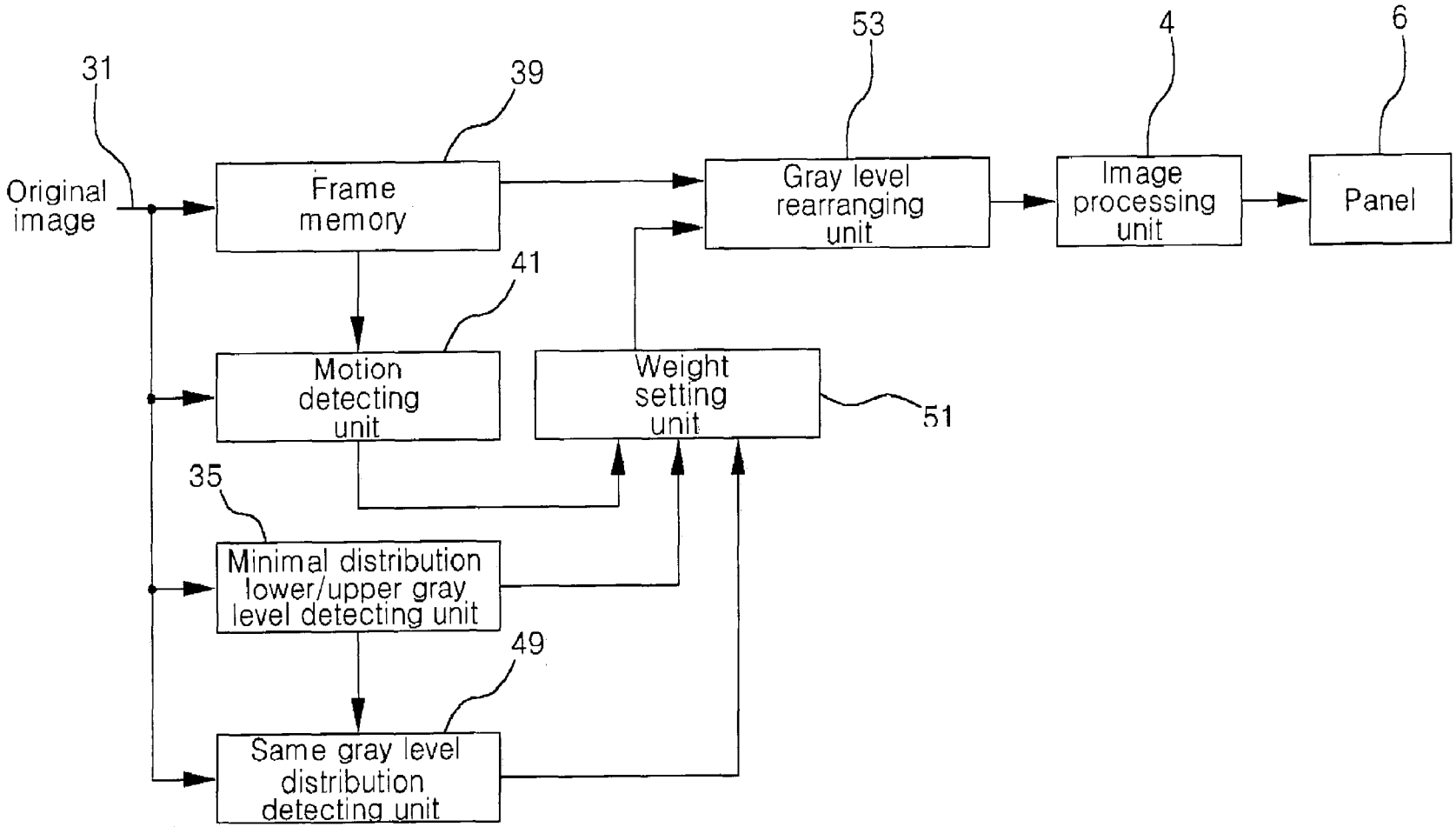
FIG. 22 illustrates further another example of a PDP driving device to prevent an excessive color change according to the second preferred embodiment of the present invention.

FIG. 22 illustrates further another example of a PDP driving device to prevent an excessive change of color according to the second preferred embodiment of the present invention. Referring to FIG. 22, the PDP driving device includes a frame memory 39, a motion detecting unit 41, a minimal distribution lower/upper gray level detecting unit 35, a same gray level distribution detecting unit 49, a weight setting unit 51, a gray level rearranging unit 53, an image processing unit 4 and a panel 6. Here, the description of the image processing unit 4 will be omitted since the image processing unit 4 is the same as the previous description. It is noted that the PDP driving device according to the second embodiment of the present invention shown in FIG. 22 further includes the same gray level distribution detecting unit 49 compared with the PDP driving device according to the second embodiment of the present invention shown in FIG. 21. The original image inputted from an input line 31 is provided to the frame memory 39, the motion detecting unit 41, the minimal distribution lower/upper gray level detecting unit 35 and the same gray level distribution detecting unit 49. The frame memory 39 is connected between the input line 31 and the gray level rearranging unit 53, temporarily stores the original image of one frame and supplies it to the motion detecting unit 41 and the gray level rearranging unit 53. The motion detecting unit 41 is connected between the input line 31 and the weight setting unit 51 in parallel to the frame memory 39 to determine whether or not a motion occurs at each position based on a comparison of one frame-delayed original image stored previously in the frame memory 39 with the original image inputted from the input line 31 so that the motion amount is calculated about how much it moves in one frame by determining each position where it moves. This calculation of the motion amount is described above. The minimal distribution lower/upper gray level detecting unit 35 is connected between the input line 31 and the weight setting unit 51 in parallel to the frame memory 39 to determine the minimal distribution lower/upper gray levels (MIN and MAX). The minimal distribution lower/upper gray level detecting unit 35 calculates a histogram distribution ratio for the gray level (for example, gray level of 0 to 20 and gray level of 220 to 255). The first gray level of which the histogram distribution ratio is equal to or less than a critical value is determined to be the minimal distribution lower/upper gray levels.

The same gray level distribution detecting unit 49 is connected between the input line 31 and the weight setting unit 51 in parallel to the frame memory 39 to calculate a degree of same gray level distribution for each color of RGB. Here, a few gray levels around one gray level can be inclusively defined as a same gray level. Accordingly, the degree of the same gray level including a few gray levels is calculated to determine how much the same gray level is distributed in each color. The weight setting unit 51 is connected to the motion detecting unit 41, the minimal distribution lower/upper gray level detecting unit 35, the same gray level distribution detecting unit 49 and the gray level rearranging unit 53, so that the minimal distribution lower/upper gray levels are re-determined using the motion amount and the same gray level distribution degree. In the other words, the weight setting unit 51 determines whether the motion amount supplied from the motion detecting unit 41 is equal to or less than a first critical value. If the motion amount is equal to or less than the first critical value, the minimal distribution lower/upper gray levels supplied from the minimal distribution lower/upper gray level detecting unit 35 are re-determined using a first weight. Here, if the first weight is applied to the minimal distribution lower gray level, the first weight is previously set to be equal to or less than 1. Desirably, if the first weight is applied to the minimal distribution upper gray level, the first weight is previously set to be equal to or greater than unity.

The weight setting unit 51 determines whether the degree of the same gray level distribution is equal to or greater than unity. If the degree of the same gray level distribution is equal to or less than a second critical value, the minimal distribution lower/upper gray levels are re-determined using the second critical value. Here, if the first weight is applied to the minimal distribution lower gray level, the first weight is previously set to be equal to or less than unity. Desirably, if the first weight is applied to the minimal distribution upper gray level, the first weight is previously set to be equal to or greater than 1. On the contrary, after the minimal distribution lower/upper gray levels are re-determined using the degree of the same gray level distribution, the re-determined minimal distribution lower/upper gray levels are determined again using the motion amount.

The weight setting unit 51 supplies the minimal distribution lower/upper gray levels supplied from the minimal distribution lower/upper gray level detecting unit 35 as itself to the gray level rearranging unit if the motion amount is equal to or greater than the first critical value or the degree of the same gray level distribution is equal to or less than the second critical value. The gray level rearranging unit 53 rearranges the one frame-delayed original image supplied from the frame memory 39 using the minimal distribution lower/upper gray levels supplied from the weight setting unit 51 or the re-determined minimal distribution lower/upper gray levels. The gray level rearranging unit 53 will not be described since it was described above.

The PDP driving unit according to the second embodiment of the present invention structured as above is designed considering that colors changes easily if a single color and the same gray level are distributed much. In the other words, if the degree of the same gray level distribution is equal to or greater than a critical value, there is a possibility that color can change. In this case, after rearranging the minimal distribution lower/upper gray levels, the original image is rearranged using the re-determined minimal distribution lower/upper gray levels so that the change of color is prevented in advance. On the other hand, as shown in FIG. 20, the original image is rearranged using the minimal distribution lower/upper gray levels so that the contrast is improved and an image can be clearly displayed. However, if the original image is rearranged using the minimal distribution lower/upper gray levels, the output images shifted to a low gray level area are not displayed clearly on a screen.

For example, when the minimal distribution lower/upper grey levels for the original image are 10 and 220 respectively, the grey level of the original image is rearranged as Table 3 by means of Expression 1

TABLE 3

| Gray level of an original image | Related expression | Rearranged gray level |
|---|---|---|
| 11 | 1/210*220 | 1 |
| 12 | 1/210*220 | 2 |
| 13 | 1/210*220 | 3 |
| . . . | . . . | . . . |

Figure 23:
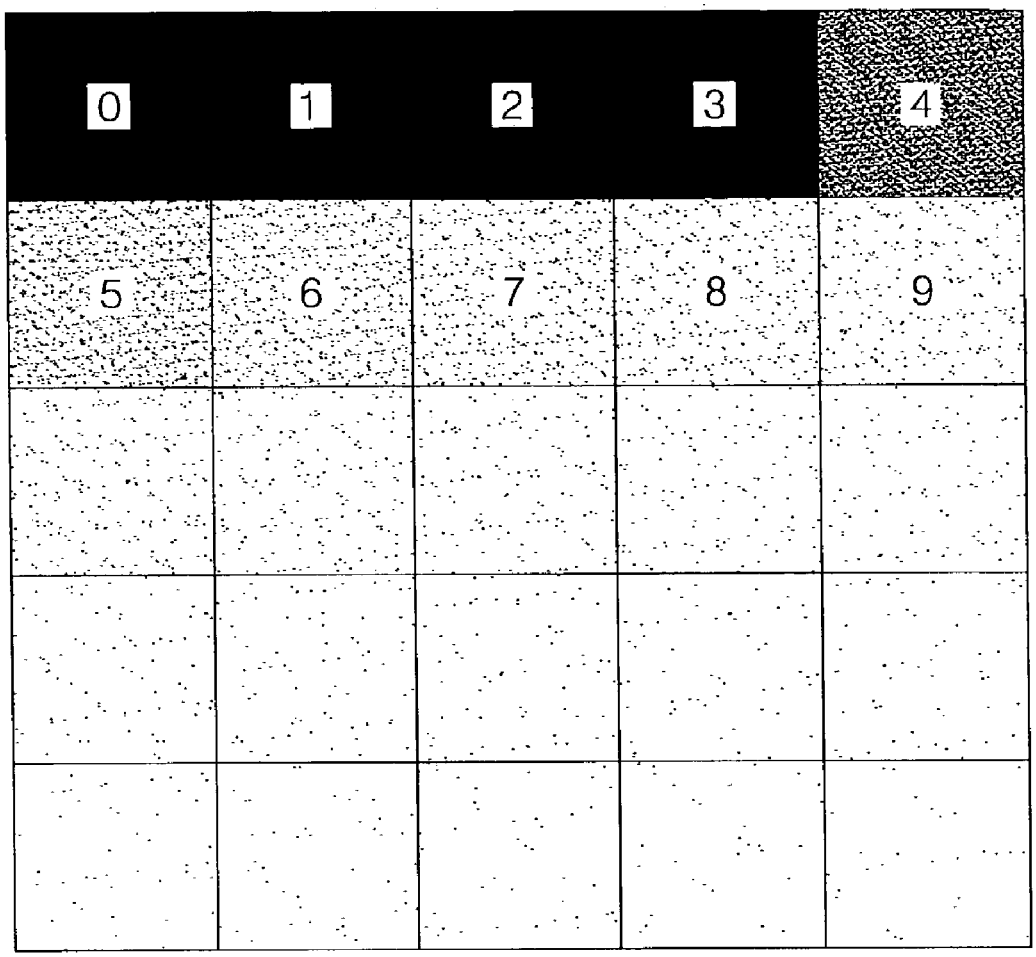
FIG. 23 illustrates a representation state during a gamma processing after rearranging original images when driving a PDP according to the first preferred embodiment of the present invention.

As shown in Table 3, the original image having gray levels of 11 to 13 is changed into an output image having gray levels of 1 to 3. In this case, after the inverse gamma correction is performed on the changed gray levels of 1 to 3, the image is not displayed on screen clearly. In the other words, if the inverse gamma correction is performed on the changed gray levels of 1 to 3, the gray levels of 1 to 4 cannot be represented as shown in FIG. 23. As a result, if the original image is rearranged using the minimal distribution lower/upper gray levels, the image cannot be represented at low gray level area.

In order to solve the problem that the low gray level occurs when rearranging the original image, a PDP driving device usually improves an image representation at the low gray level using an error propagation. However, an image having the low gray level is limited to be displayed clearer using this error propagation.

Now, there will be described the preferred embodiment of the present invention for solving the problem of the low gray level caused when rearranging the original image.

Figure 24:
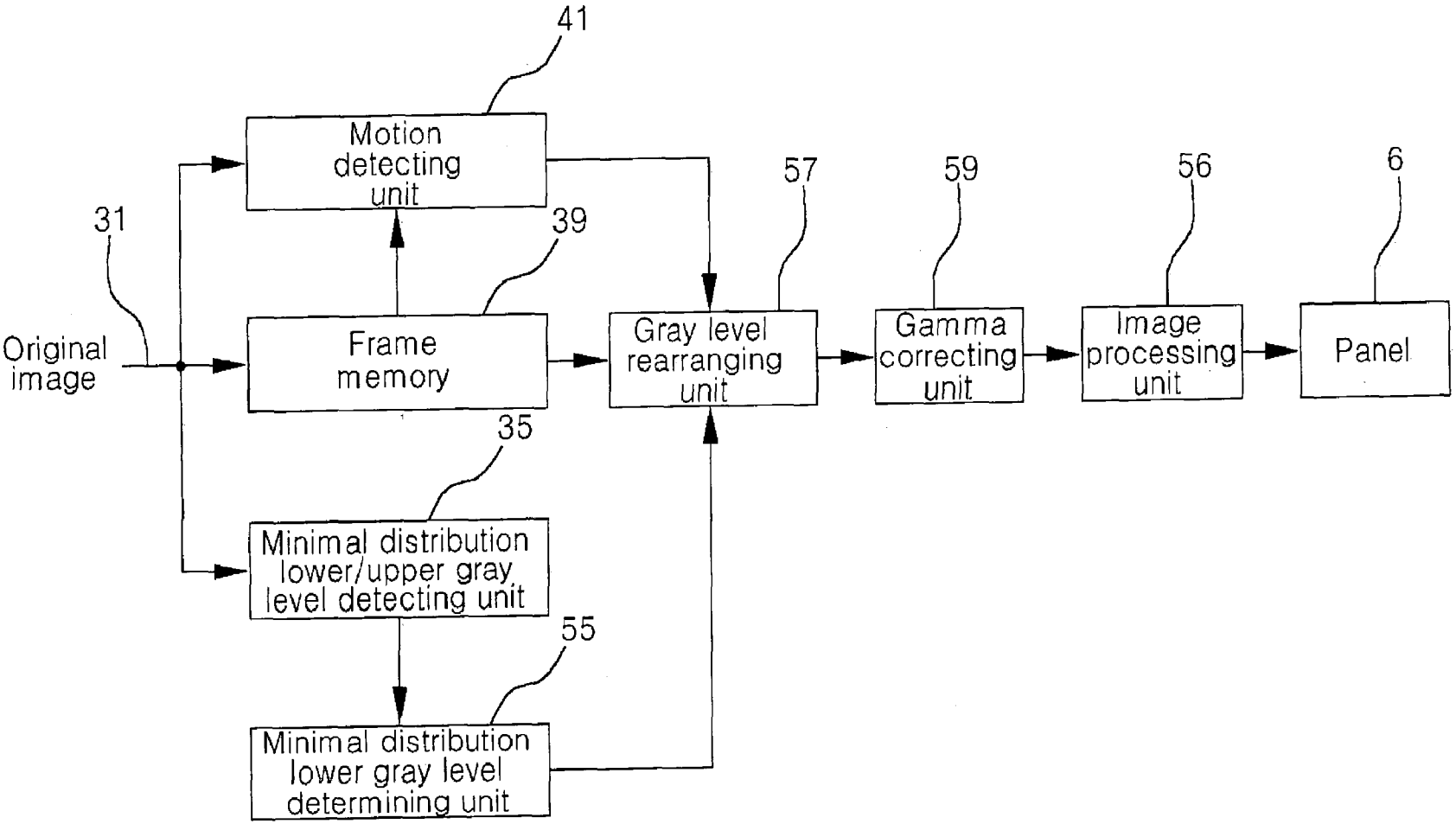
FIG. 24 illustrates a PDP driving device for solving the low gray level according to a third preferred embodiment of the present invention.

FIG. 24 illustrates a PDP driving device capable of solving the problem of the low gray level according to a third preferred embodiment of the present invention. Referring to FIG. 24, the PDP driving device according to the third preferred embodiment of the present invention includes a frame memory 39, a motion detecting unit 41, a minimal distribution lower/upper gray level detecting unit 35, a minimal distribution lower gray level determining unit 55, a gray level rearranging unit 57, a gamma correcting unit 59, an image processing unit 56 and a panel 6. Here, the image processing unit 56 of FIG. 24 does not have the gamma correcting unit 59 compared with that of FIG. 4. It is noted that the gamma correcting unit 59 is not included in the image processing unit 56 since the gamma correcting unit 59 is the characteristic component of the present invention. In the other words, the remaining components such as a gain control unit, an error propagation unit, a subfield mapping unit, a data sorting unit, an APL arithmetic unit and a waveform generation unit will not described since their description is the same as the description for FIG. 4.

Figure 25:
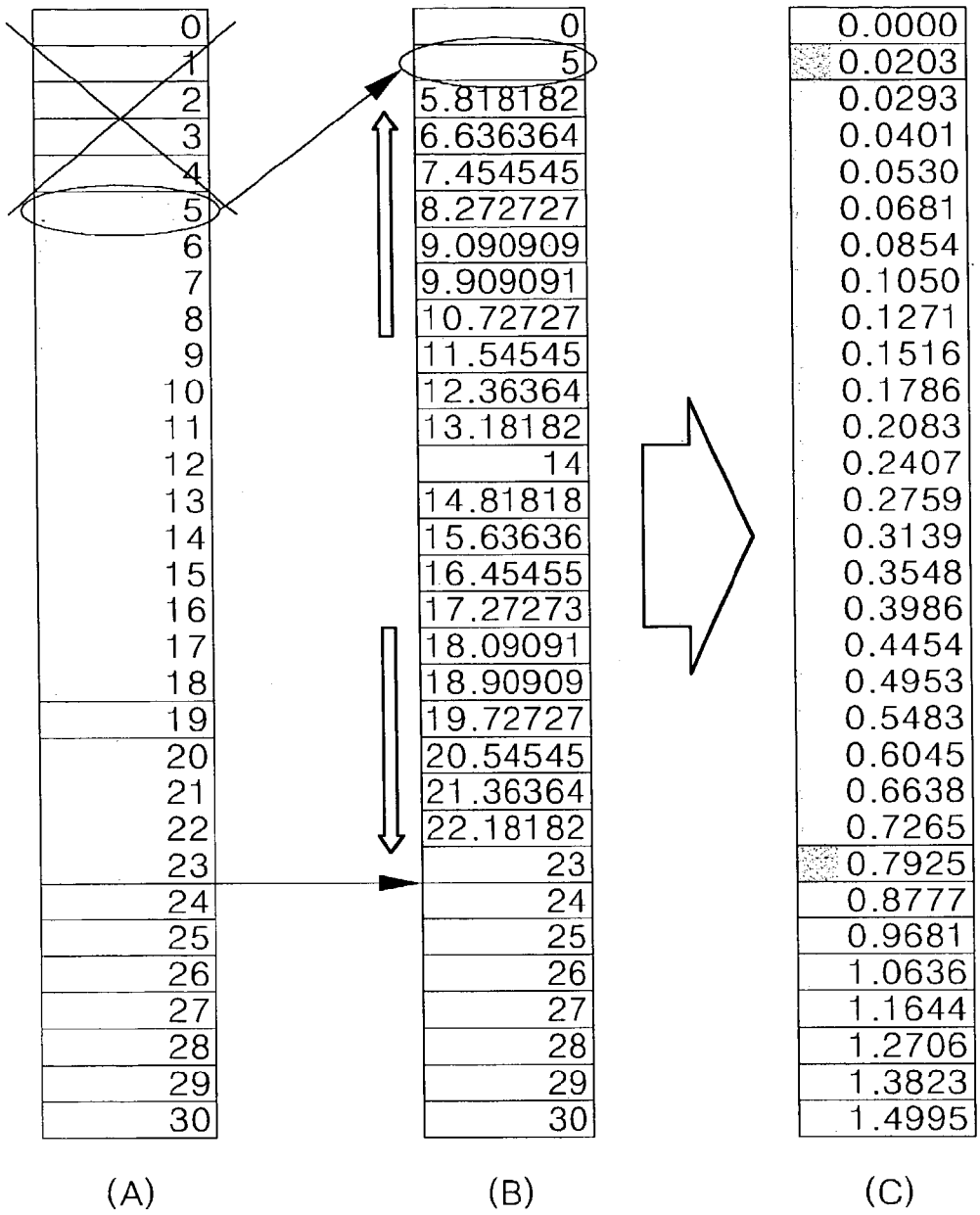
FIG. 25 illustrates a brightness in accordance with a rearrangement of an original image in a PDP driving device according to the third preferred embodiment of the present invention.

As shown in FIG. 25 (A), the original image inputted from an input line 31 is provided to the frame memory 39, the motion detecting unit 41 and the minimal distribution lower/upper gray level detecting unit 35. The frame memory 39 is connected between the input line 31 and the gray level rearranging unit 57, temporarily stores the original image and supplies it to the motion detecting unit 41 and the gray level rearranging unit 57. The motion detecting unit 41 determines whether or not a motion occurs at each position based on a comparison of one frame-delayed original image stored previously in the frame memory 39 with the original image inputted from the input line 31. The motion amount is calculated by performing this motion detection on the entire frame. The minimal distribution lower/upper gray level detecting unit 35 is connected between the input line 31 and the minimal distribution lower gray level determining unit 55 in parallel to the frame memory 39 to determine the minimal distribution lower/upper gray levels based on a comparison of the histogram distribution ratio calculated using a histogram with a crucial value. The minimal distribution lower gray level determining unit 55 is connected between the minimal distribution lower/upper gray level detecting unit 35 and the gray level rearranging unit 57 to compare the minimal distribution lower gray level with the critical value having representation. The comparison result is provided to the gray level rearranging unit 57. The gray level rearranging unit 57 is connected to the frame memory 39, the motion detecting unit 41, the minimal distribution lower gray level determining unit 55 and the gamma correcting unit 59 to rearrange the original image supplied from the frame memory 39. On the other hand, the gray level rearranging unit 57 determines whether the one frame-delayed original image is rearranged, using the comparison result provided from the minimal distribution lower gray level determining unit 55. If the minimal distribution lower gray level is equal to or less than the critical value of presentation, the one frame-delayed original image is not rearranged but supplied to the gamma correcting unit 59.

If the minimal distribution lower gray level is equal to or greater than the critical value of presentation, the gray level rearranging unit 57 determines whether the one frame-delayed original image is a moving image, using the motion amount supplied from the motion detecting unit 41. If it is determined that it is a moving image, the gray level rearranging unit 57 rearranges the one frame delayed image using a changed gamma table previously set as shown in FIG. 25 (B). Here, some low gray level area is changed in the changed gamma table. For example, if the critical value of representation is 5 and the minimal distribution lower gray level is equal to or greater than 5, the gray level rearranging unit 57 rearranges the gray levels of the one frame-delayed original image as 5, 5.8, 6.6, 7.4, 8.2, . . . , 23, 24, 25, . . . . As above, in the PDP driving device according to the third embodiment of the present invention may have the changed gamma table as shown in FIG. 25 (B) to apply the changed gamma table to rearrangement if the minimal distribution lower gray level is equal to or greater than the critical value of representation.

On the other hand, the gamma correcting unit 59 performs inverse gamma correction on the one frame-delayed original image that is rearranged by the gray level rearranging unit 57 or not rearranged. In this time, the brightness according to each gray level is calculated as shown in FIG. 25 (C).

Figure 26:
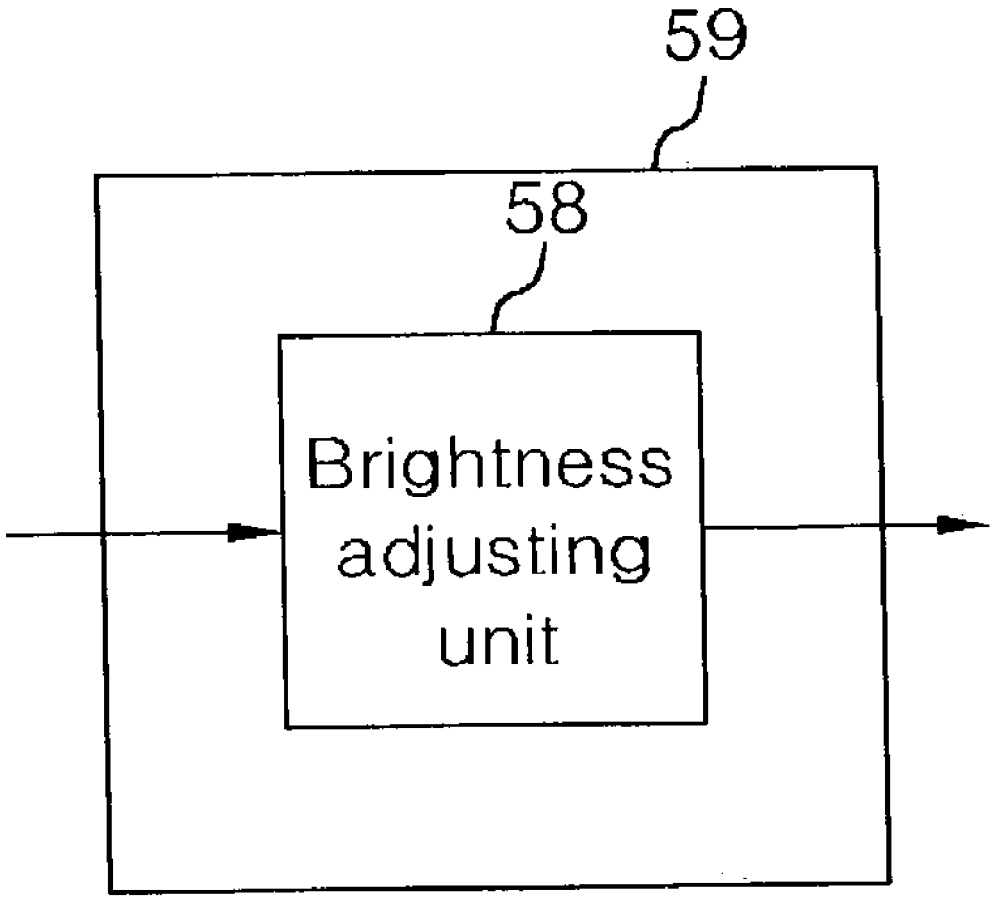
FIG. 26 illustrates a brightness adjustment unit included in a gamma correction unit in a PDP driving device according to the third preferred embodiment of the present invention.

The gamma correcting unit 59 includes a brightness adjustment unit 58 for adjusting the brightness of the inverse corrected original image as shown in FIG. 26. The brightness adjustment unit 58 adjusts the brightness to the middle value of the brightness corresponding to each gray level of inverse corrected original image. This is represented as mathematically as the following expression.

Expression 4

$$B(I) = \frac{A(I) + A(I-1)}{2}$$

where A(I) is the brightness of the gray level of the inverse gamma corrected original image; and B(I) is the middle value of the brightness values.

For example, as shown in FIG. 25, the brightness values due to inverse gamma correction at the gray levels of 5 and 5.8 are 0.203 and 0.293. In this case, the middle value of the changed brightness for gray level of 5.8 is obtained to be 0.0248 by applying 0.0203 and 0.0293 to Expression 4. As described above, the brightness values adjusted by the brightness adjuster 58 is shown in FIG. 27.

Figure 28:
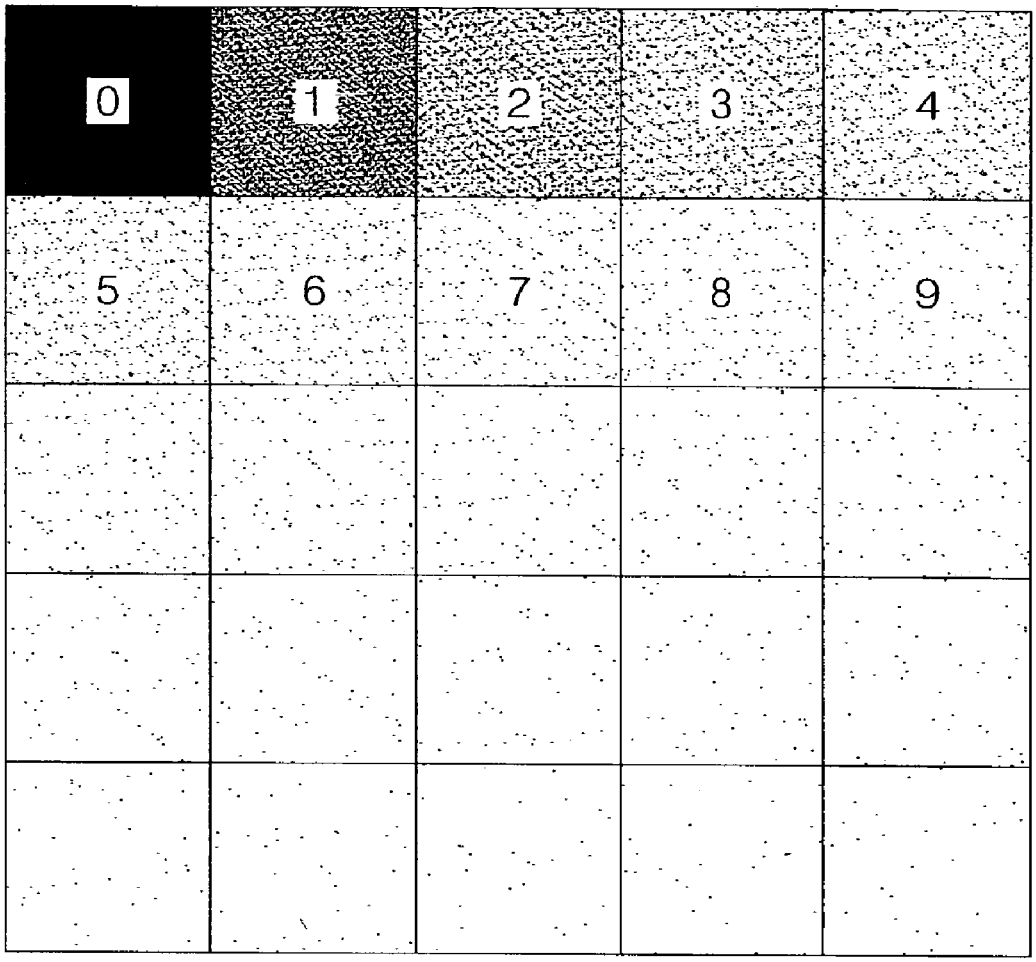
FIG. 28 illustrates an expression state during a gamma processing after a rearrangement of an original image when driving a PDP driving device according to the third preferred embodiment of the present invention.

The PDP driving device according to the third embodiment of the present invention as described above rearranges the remaining gray levels except for the gray level equal to or less than the gray level of representation so that uniform image is displayed on a screen for the entire gray levels as shown in FIG. 28 and a contrast is also improved. This invention obviates the problem of the low gray level caused when rearranging the original image. On the other hand, as shown in FIG. 20, the original image is rearranged using the minimal distribution lower and upper gray level so that a contrast is improved and an image is displayed clearly. However, if the original image is rearranged using the minimal distribution lower and upper gray level, it is saturated at a high gray level so that a correct gamma characteristic cannot be obtained. For example, it is assumed that the gray levels for red, green and blue images are 205, 20 and 205 respectively and the minimal distribution lower and upper gray levels are 0 and 215 respectively. Referring to Expression 2, if the gray level for each image is rearranged, all the gray levels are 255 from the minimal distribution upper gray level of 215. This is depicted in FIG. 29.

Figure 29:
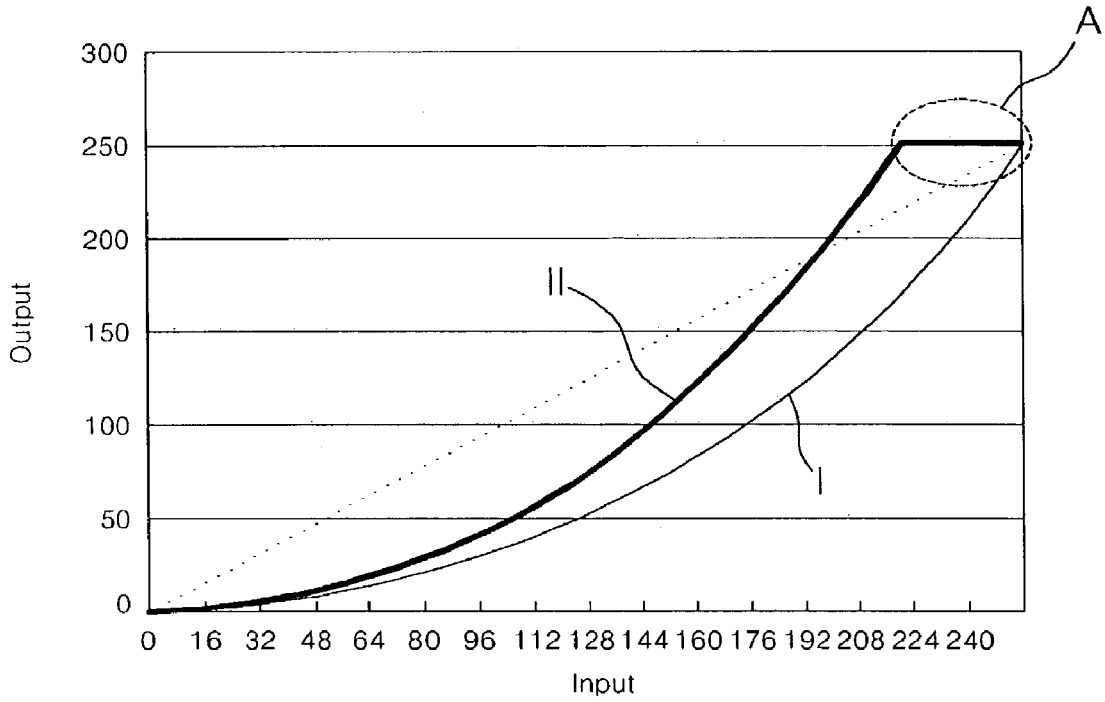
FIG. 29 is a graph illustrating a gamma output state during a gamma processing after a rearrangement of an original image.

FIG. 29 is a graph illustrating a gamma output state during a gamma processing after rearranging an original image. Here, 'I' represents a gamma output state during the gamma processing on the original image that is not rearranged, and 'II' represents a gamma output state during the gamma processing on the rearranged original image. The linear straight line represents the case that the original image is not rearranged and a gamma processing is not performed on the original image. As shown in FIG. 29, in case that a gamma processing is performed on the rearranged original image, the gray levels equal to or greater than the minimal distribution upper gray level area are all saturated to be 255 ('A' area). Accordingly, in the gray levels equal to or greater than the minimal distribution upper gray level area, a correct gamma output characteristic does not appear. Now, the method of linearly correcting the wrong gamma output characteristic according to the above-mentioned saturation area A will be described.

Figure 30:
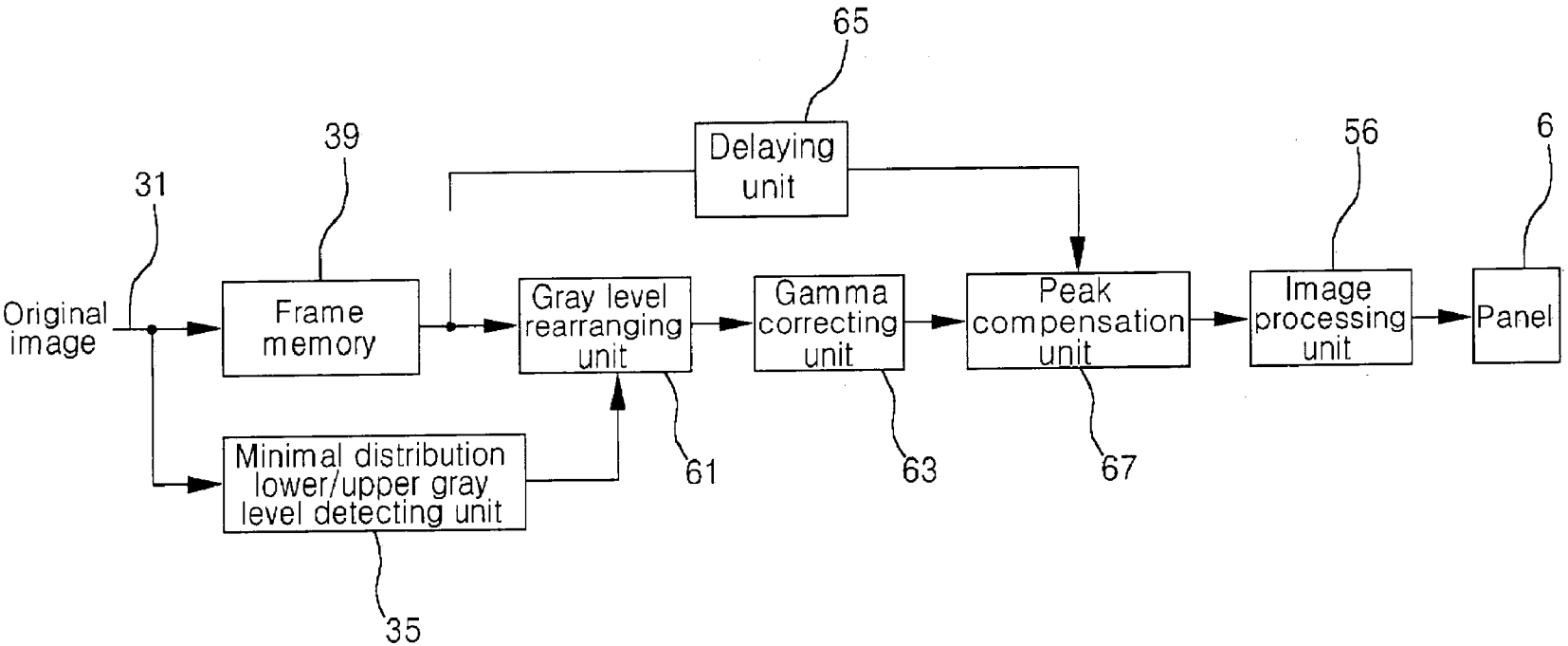
FIG. 30 illustrates a PDP driving device for correcting linearly the gray levels equal to or greater than the minimal distribution upper gray level according to a fourth preferred embodiment of the present invention.

FIG. 30 illustrates a PDP driving device for linearly correcting the gray levels equal to or greater than the minimal distribution upper gray level according to a fourth preferred embodiment of the present invention. Referring to FIG. 30, the PDP driving device according to a fourth preferred embodiment of the present invention includes a frame memory 39, a minimal distribution lower/upper gray level detecting unit 35, a gray level rearranging unit 61, a gamma correcting unit 63, a delaying unit 65, a peak compensating unit 67, an image processing unit 56 and a panel 6. Here, since the description of a frame memory 39, a minimal distribution lower/upper gray level detecting unit 35, a gray level rearranging unit 61, a gamma correcting unit 63, an image processing unit 56 and a panel 6 was made above, the description of them will be omitted.

The gamma correcting unit 63 performs a gamma correction to the original image rearranged by the gray level rearranging unit 61. The output gray level which is gamma-corrected is supplied to the peak compensating unit 67. Here, the rearranged original image is saturated at a high gray level area as shown in FIG. 29. On the other hand, the original image outputted from the frame memory 39 is delayed for a predetermined time by the delaying unit 65 and the output gray level of the original image is provided to the peak compensating unit 67. Here, the predetermined time means the time for which the original image is rearranged and an inverse gamma correction is performed. Accordingly, the output gray level of the original image which is gamma-corrected and the output gray level of the original image delayed for the predetermined time are the same frame. Thus, one of the original images of the same frame is delayed for the predetermined time and another of the original images of the same frame is rearranged and corrected by the gamma correction, so that the two images are simultaneously compared in the peak compensating unit 67.

Figure 31:
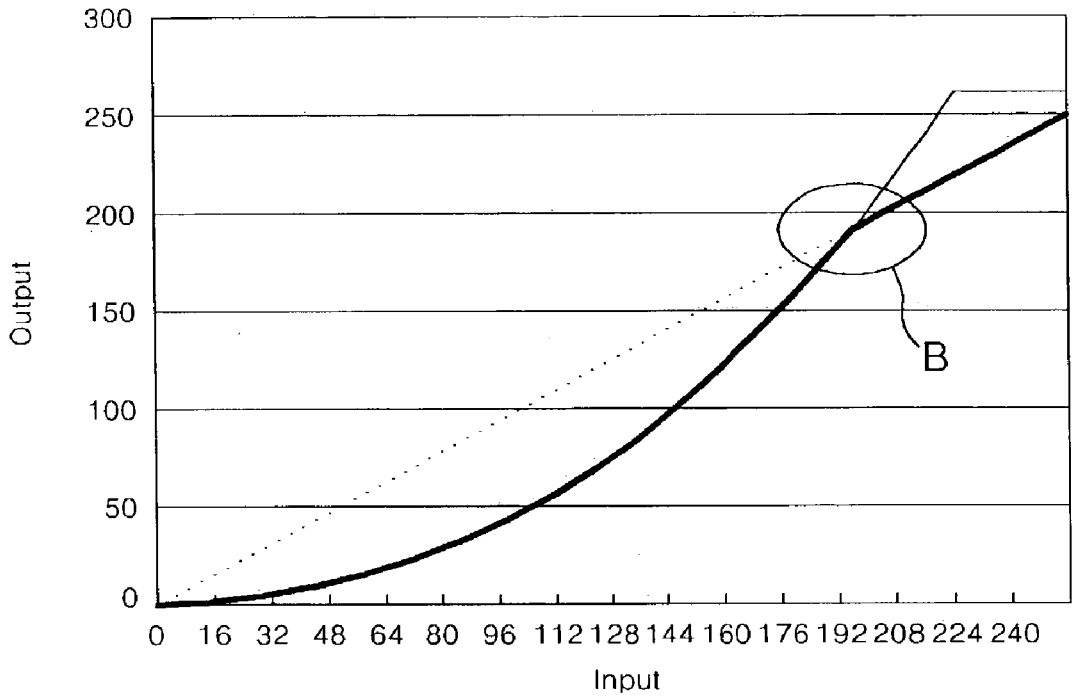
FIG. 31 illustrates a gamma output state during applying a peak compensation value to an output gamma curve in a PDP driving device according to a fourth preferred embodiment of the present invention.

The peak compensating unit 67 compares the output gray level of the original image supplied from the delaying unit 65 with the gamma-corrected output gray level of the original image supplied from the gamma correcting unit 63 and determines a peak compensation value used to selectively output a gamma output curve as shown in FIG. 31. On the other hand, if the output gray level of the original image is equal to or greater than the gamma-corrected output gray level, the gamma-corrected output gray level is determined to be the peak compensation value.

If the output gray level of the original image is less than the gamma-corrected output gray level, the output gray level of the original image is determined to be the peak compensation value. As shown in FIG. 31, the peak compensating unit 67 outputs the gamma-corrected output gray level if an input gray level is equal to or less than the input gray level corresponding to the position B where the output gray level of the original image is the same as the gamma-corrected output gray level. To the contrary, the peak compensating unit 67 outputs the output gray level of the original image if an input gray level is greater than the input gray level corresponding to the position B. Accordingly, a new gamma output curve is generated by the peak compensation value of the peak compensating unit 67 selectively determined depending on the output gray level and the gamma-corrected output gray level.

The PDP driving device according to a fourth preferred embodiment of the present invention compares the output gray level of the original image with the gamma-corrected output gray level and can selectively output a gamma output curve according to the comparison result. Accordingly, it is prevented that the gray levels of the original image equal to or greater than the minimal distribution upper gray level are all saturated to be 255. This prevents the output image displayed on a screen from being distorted.

Meanwhile, hereinafter, there will be described the method of preventing a deterioration of picture quality, which is caused by a round-off error at a low brightness gray level, by differently selecting gamma curves according to respective images and correcting the gray level.

Figure 32:
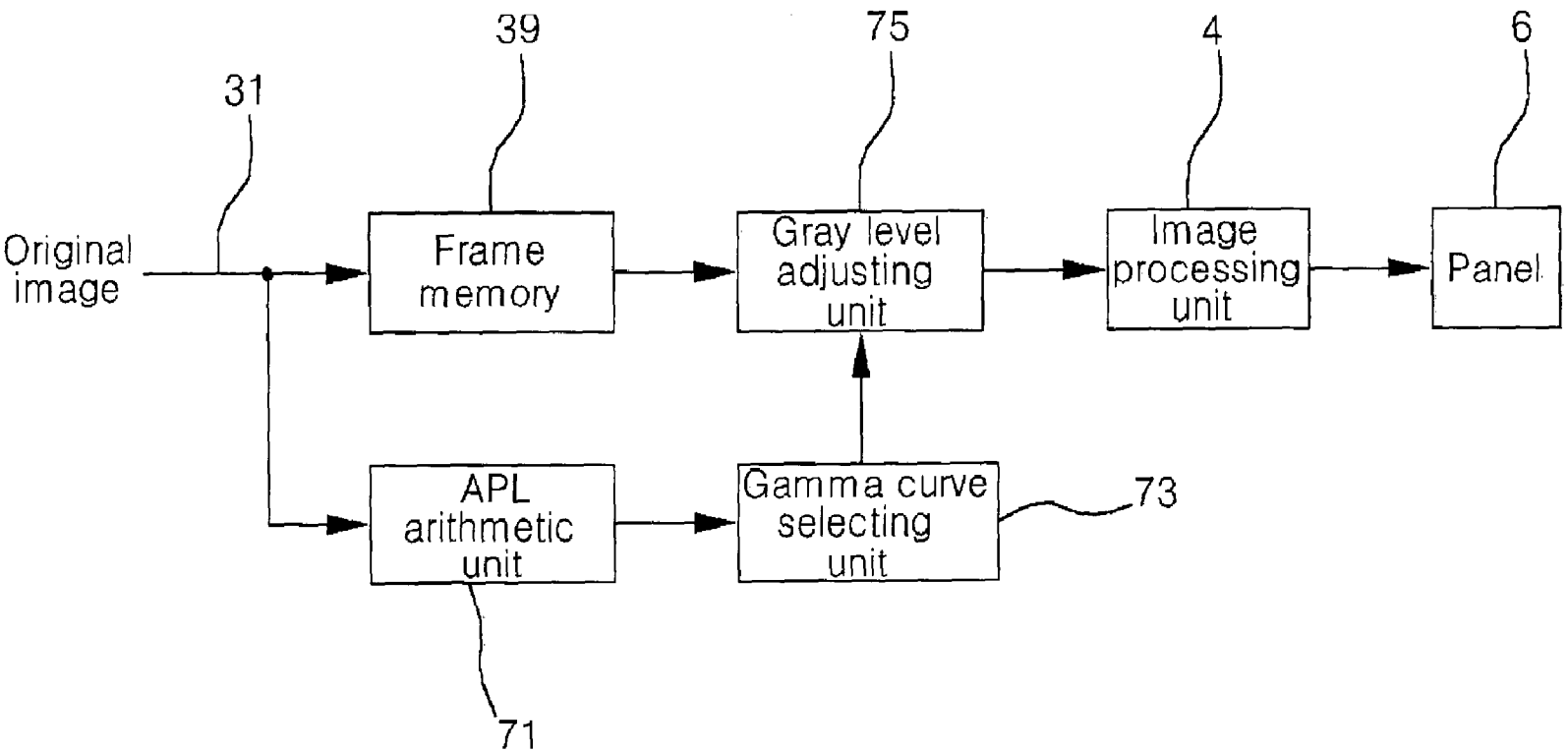
FIG. 32 illustrates a PDP driving device to reduce a picture quality deterioration effect according to a preferred embodiment of the present invention.

FIG. 32 illustrates a PDP driving device to reduce a picture quality deterioration according to a preferred embodiment of the present invention. Referring to FIG. 32, the PDP driving device according to an embodiment of the present invention includes a frame memory 39, an ALP calculating unit 71, a gamma curve selecting unit 73, a gray level adjusting unit 75, an image processing unit 56 and a panel 6. Here, since the description of the image processing unit 56 and the panel 6 was made above, the description of them will be omitted.

An original image inputted from the input line 31 is supplied to the frame memory 39 and an ALP calculating unit 71. The frame memory 39 is connected between the input line 31 and the gray level adjusting unit 75, temporarily stores the original image of one frame and supplies it to the gray level adjusting unit 75. The ALP calculating unit 71 is connected between the input line 31 and the gamma curve selecting unit 73 in parallel to the frame memory 39, calculates an average brightness level for the original image and supplies the calculation result to the gamma curve selecting unit 73. One frame includes gray levels different from each other and brightness values for the gray levels.

Figure 33:
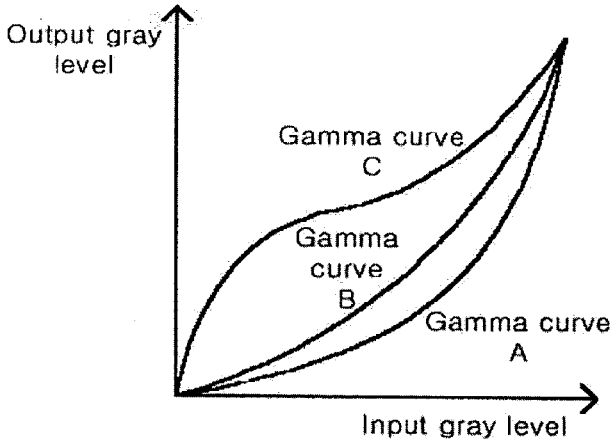
FIG. 33 illustrates a gamma curve selected according to an average brightness level of an original image according to a preferred embodiment of the present invention.

Accordingly, an average of all the brightness values for the gray levels is obtained by calculating average brightness levels. The gamma curve selecting unit 73 has a plurality of gamma curves which can be selected according to the average brightness levels. In the present invention, as shown in FIG. 33, the average brightness level is classified into low, middle and high, and three gamma curves can be prepared in advance. The gray level adjusting unit 75 adjusts the gray level of the one frame-delayed original image using the gamma curve selected by the gamma curve selecting unit 73. Accordingly, the gray level outputted from the gray level adjusting unit 75 depends on the gamma curve selected by the gamma curve selecting unit 73. In other words, as shown in FIG. 33, the gamma curve C is selected when the average brightness level is low. The gamma curve B is selected when the average brightness level is middle. The gamma curve A is selected when the average brightness level is high. The brightness of the entire gray level is enhanced by selecting the gamma curve C when the average brightness level is low. Especially, the brightness of a lower gray level is enhanced much more to thereby prevent a deterioration of the image at low gray level.

As a result, in an embodiment of the present invention, a plurality of the gamma curves are prepared in advance. One of the gamma curves is selected according to the average brightness level. The gray level of the original image is corrected using the selected gamma curve. The optimal gamma curve suitable for all images can be used in correcting gray level and especially preventing a deterioration of the images at low gray level in advance.

Figure 34:
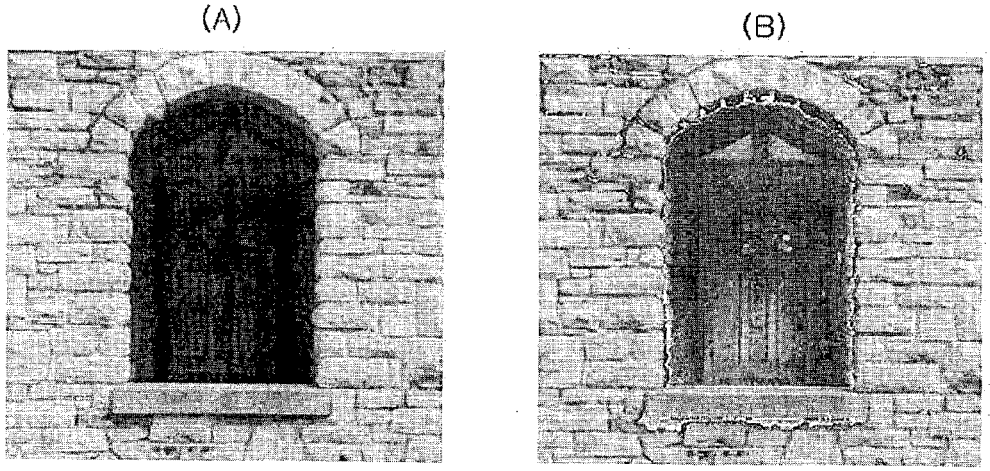
FIG. 34 illustrates an image the quality of which is improved by a PDP driving device according to a preferred embodiment of the present invention.

FIG. 34 illustrates an image the quality of which is improved by a PDP driving device according to a preferred embodiment of the present invention. Here, (A) is the image before being corrected and (B) is the image after being corrected. Accordingly, it can be seen that the quality of the corrected image (B) is much improved compared with the quality of the image (A) before being corrected.

Figure 35:
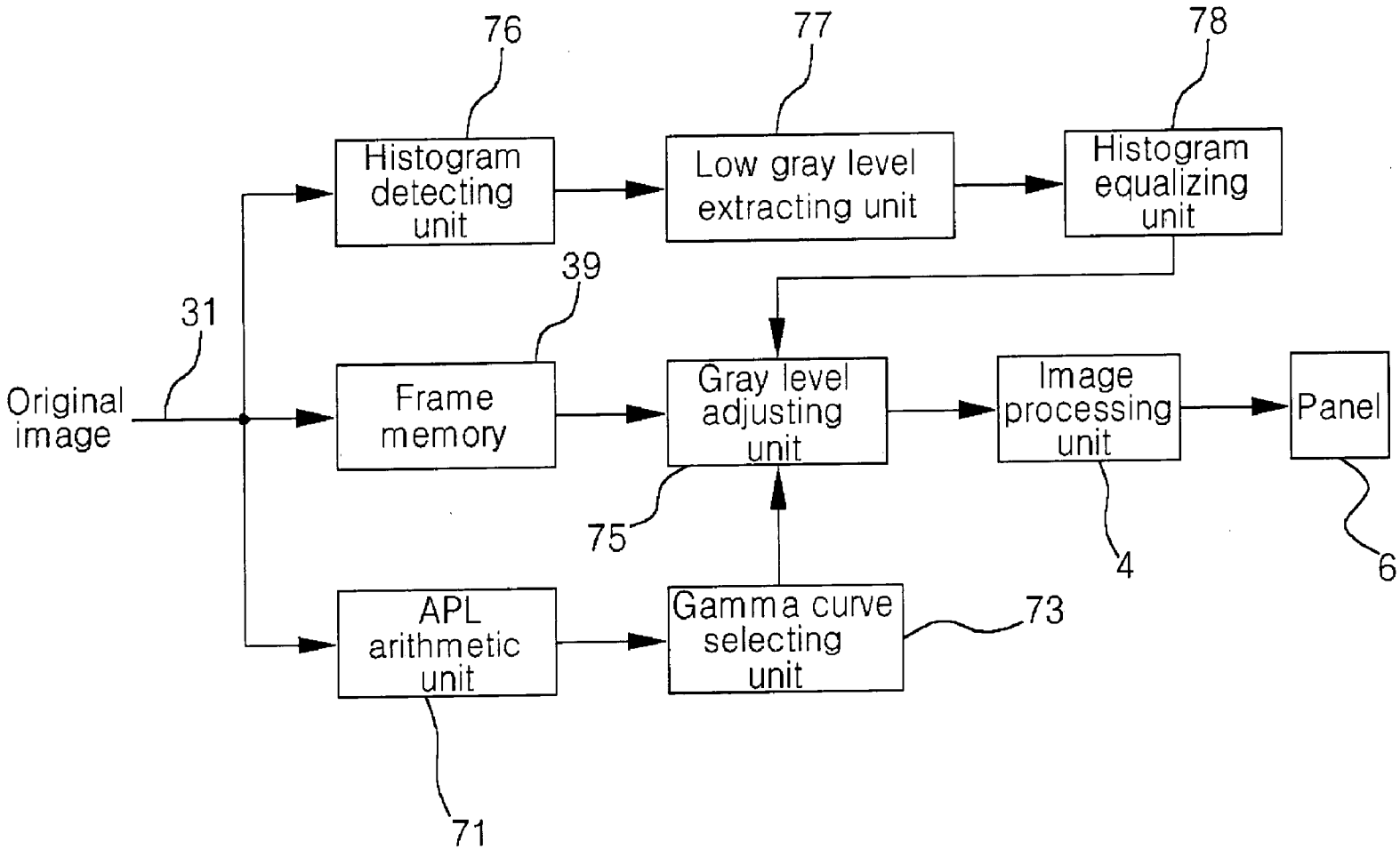
FIG. 35 illustrates a PDP driving device to reduce a picture quality deterioration effect according to another preferred embodiment of the present invention.

FIG. 35 illustrates a PDP driving device to reduce a picture quality deterioration according to another preferred embodiment of the present invention. Referring to FIG. 35, the PDP driving device according to the fifth embodiment of the present invention includes a frame memory 39, an ALP calculating unit 71, a gamma curve selecting unit 73, a histogram detecting unit 76, a low gray level extracting unit 77, a histogram equalizing unit 78, a gray level adjusting unit 75, an image processing unit 56 and a panel 6. Here, since the description of the frame memory 39, the ALP calculating unit 71, the gamma curve selecting unit 73, the image processing unit 56 and the panel 6 was made above, the description of them will be omitted.

The histogram detecting unit 76 is connected between an input line 31 and the low gray level extracting unit 77 and calculates the distribution number for each gray level of the original image supplied from the input line 31. The low gray level extracting unit 77 compares the histogram distribution number with a critical value and extracts the low gray level area. In other words, all the gray levels equal to or less than the gray level of which the calculated distribution number is equal to or less than the critical value is extracted as the low gray level area. There are various methods of extracting the low level gray level in the low gray level extracting unit 77. The methods include an intensive thresholding method, a region growing method, a contour following method, a watershed method, etc. The histogram equalizing unit 78 equalizes histogram for the low gray level area extracted by the low gray level extracting unit 77. This histogram equalization is to generate a histogram having a predetermined distribution when bright and dark distribution is low so that an image quality is improved. The low gray level area a histogram of which is equalized by the histogram equalizing unit 78 is supplied to the gray level adjusting unit 75. The gray level adjusting unit 75 corrects the gray level of the one frame-delayed original image supplied from the frame memory 39 using the gamma curve selected according to an average brightness level calculated by the ALP calculating unit 71 and the low gray level area equalized by the histogram equalizing unit 78. In other words, first, when the gray level is corrected using the gamma curve selected by the gamma curve selecting unit 73, one frame-delayed original image gray level is corrected using the low gray level area equalized by the histogram equalizing unit 78 instead of the low gray level area of the selected gamma curve while the remaining gray levels are corrected except for the low gray level area of the selected gamma curve.

Figure 36:
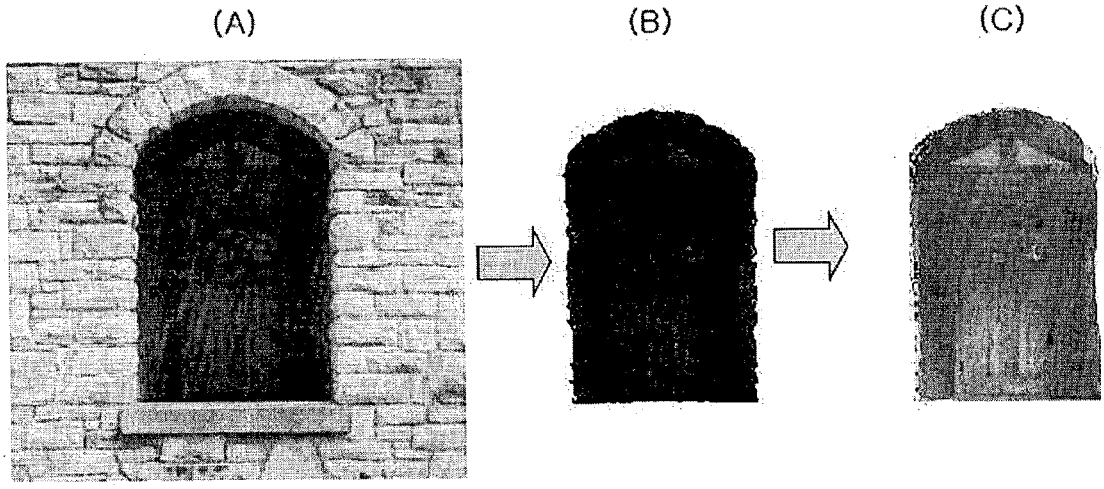
FIG. 36 illustrates a process of a histogram equalization on a low gray level area in a PDP driving device according to another preferred embodiment of the present invention.

FIG. 36 illustrates a procedure of a histogram equalization on a low gray level area in a PDP driving device according to another preferred embodiment of the present invention. As shown in FIG. 36, the low gray level area (B) of the original image (A) is extracted and the histogram equalization is performed to make a picture quality of entire image clear.

Figure 37:
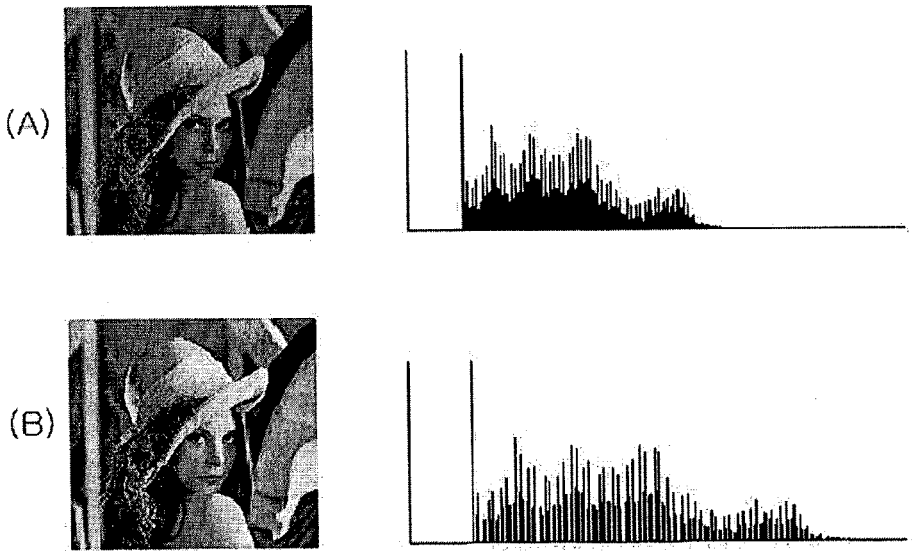
FIG. 37 illustrates an image resulted from a histogram equalization in a PDP driving device according to another preferred embodiment of the present invention.

FIG. 37 illustrates an image resulted from a histogram equalization in a PDP driving device according to another preferred embodiment of the present invention. Here, (A) represents the state before histogram equalization and (B) represents a state after the histogram equalization. As shown in FIG. 37 (B), a histogram equalization is performed so that the histogram distribution gets uniform. This makes an image to be displayed more clearly.

As described above, in another embodiment of the present invention, the optimal gamma curve is selected according to each image to correct the gray level of the original image while the low gray level area of the original image is separately extracted to make histogram distribution uniform. The gray levels corresponding to all the images are corrected and also especially make the low gray level area clearer to thereby prevent a deterioration of the picture quality.

As mentioned above, according to the PDP driving device of the present invention, a predetermined upper and lower gray levels are removed and the gray levels that are not removed are expanded upward and downward to thereby enhance the contrast.

According to the PDP driving device of the present invention, the minimal distribution lower/upper gray levels are determined using a histogram, and the gray level of the original image is expanded using the determined minimal distribution lower/upper gray levels. Therefore, the contrast can be improved and thus a clearer picture quality can be implemented on a screen.

According to the PDP driving device of the present invention, when rearranging the gray level of the original image, the gray level of the original image is rearranged considering a motion between frames, so that an excessive change of color is prevented.

According to the PDP driving device of the present invention, when rearranging the gray level of the original image, the gray level of the original image is rearranged using only the gray levels equal to or greater than the representation gray level, so that a representation at the low gray level area is enhanced.

According to the PDP driving device of the present invention, when rearranging the gray level of the original image, the peak compensation value selected according to the comparison of the gamma-corrected gray level of the original image with the gray level of a predetermined time delayed original image is applied to a gamma curve, so that the high gray level area equal to or greater than the minimal distribution upper gray level is prevented from saturating and an output image distortion is avoided.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A driving method for a flat panel display comprising:

(a) determining minimal distribution lower and upper gray levels of an original image using a histogram; and (b) rearranging a gray scale distribution of the original image based on the minimal distribution lower and upper gray levels, wherein rearranging the gray scale distribution comprises:

calculating a motion amount using the original image and a delayed original image, and rearranging a gray level distribution of the delayed original image using the motion amount and the minimal distribution lower and upper gray levels, wherein each of the minimal distribution lower and upper gray levels is re-determined using a preset weight if the calculated motion amount is equal to or less than a predetermined critical value.

2. The driving method according to claim 1, wherein determining the minimal distribution lower and upper gray levels comprises:

calculating histogram distribution ratios of gray levels within a specific range; and determining the minimal distribution lower and upper gray levels corresponding to a preset critical value among the calculated histogram distribution ratios.

3. The driving method according to claim 2, wherein the gray levels within the specific range are 0–20 gray levels.

4. The driving method according to claim 2, wherein the gray levels within the specific range are 220–255 gray levels.

5. The driving method according to claim 1, wherein rearranging the gray scale distribution further comprises:

expanding a gray level range of the original image using gray levels existing between the minimal distribution lower and upper gray levels.

6. The driving method according to claim 5, wherein the gray level range of the original image is calculated by:

dividing a difference between the minimal distribution lower gray level and each of the gray levels existing between the minimal distribution lower and upper gray levels by a difference between the minimal distribution lower gray level and the minimal distribution upper gray level; and multiplying a maximum distribution gray level by the result of the dividing.

7. The driving method according to claim 1, wherein calculating the motion amount comprises:

detecting a motion by comparing a gray level of the original image with a gray level of the delayed original image; and performing a motion detection with respect to pixels of one frame to calculate the motion amount.

8. The driving method according to claim 7, wherein the motion detection is performed at similar points of the original image and the delayed original image.

9. The driving method according to claim 1, wherein rearranging the gray level distribution of the delayed original image comprises:

determining whether the delayed original image is a moving image or a still image using the motion amount; and when it is determined that the delayed original image is the moving image, expanding gray level range of the delayed original image using the gray levels existing between the minimal distribution lower and upper gray levels.

10. The driving method according to claim 9, wherein rearranging the gray level distribution of the delayed original image further includes:

when it is determined that the delayed original image is the still image, not rearranging gray level of the delayed original image.

11. The driving method according to claim 1, wherein rearranging the gray level distribution of the delayed original image comprises:

determining whether the minimal distribution lower and upper gray levels should be reset using the motion amount; and expanding a gray level range of the delayed original image using the gray levels existing between the determined minimal distribution lower and upper gray levels.

12. The driving method according to claim 1, wherein a weight for the minimal distribution lower gray level is set to be equal to or less than unity.

13. The driving method according to claim 1, wherein a weight for the minimal distribution upper gray level is set to be equal to or greater than unity.

14. The driving method according to claim 1, wherein weights for the minimal distribution lower and upper gray levels are not given if the calculated motion amount is equal to or less than a predetermined critical value.

15. A driving method for a flat panel display comprising:

determining minimal distribution lower and upper gray levels of an original image using a histogram; and rearranging a gray scale distribution of the original image based on the minimal distribution lower and upper gray levels, wherein rearranging the gray scale distribution comprises:

calculating a motion amount using the original image and a one frame-delayed original image;

detecting a degree of a same gray level distribution for an original image;

re-determining the minimal distribution lower and upper gray levels using the motion amount and the same gray level distribution; and rearranging a gray level distribution of the one frame-delayed original image using the minimal distribution lower and upper gray levels, wherein re-determining the minimal distribution lower and upper gray levels comprises:

determining whether the calculated motion amount is equal to or less than a first critical value and setting a first weight if the calculated motion amount is equal to or less than the first critical value;

determining whether a degree of the same gray level distribution is equal to or less than a second critical value and setting a second weight if the degree of the same gray level distribution is equal to or less than the second critical value; and re-determining the minimal distribution lower and upper gray levels using the first and second weights.

16. The driving method of claim 15, wherein determining the minimal distribution lower and upper gray levels comprises:

calculating a histogram distribution ratio of gray levels for the original image; and detecting the minimal distribution lower and upper gray levels corresponding to a critical value among the calculated histogram distribution ratio.

17. The driving method of claim 15, wherein calculating the motion amount comprises:

detecting a motion by comparing the gray level of the original image with a gray level of the one frame-delayed original image; and calculating a motion amount by performing the motion detection with respect to all pixels of one frame.

18. The driving method of claim 15, wherein, when re-determining the minimal distribution lower and upper gray levels, the first and second critical values are equal to or less than unity.

19. The driving method of claim 15, wherein, when re-determining the minimal distribution lower and upper gray levels, the first and second critical values are equal to or greater than unity.

20. The driving method of claim 15, wherein, when the calculated motion amount is equal to or greater than the first critical value and the degree of the same gray level distribution is equal to or less than the second critical value, the minimal distribution lower and upper gray levels are not re-determined.

21. The driving method of claim 15, wherein rearranging the gray level distribution comprises:

expanding a range of the gray level of the one frame-delayed original image using gray levels existing between the re-determined minimal distribution lower and upper gray levels.

22. A driving device for a flat panel display, the driving device comprising:

minimal distribution lower and upper gray level determining means for determining minimal distribution lower and upper gray levels of an original image using a histogram; and rearranging means for rearranging a gray scale distribution of the original image based on the minimal distribution lower and upper gray levels, wherein the rearranging means calculates a motion amount using the original image and a one frame-delayed image and the rearranging means rearranges the gray level distribution of the one frame-delayed original image using the motion amount and the minimal distribution lower and upper gray levels, wherein the rearranging means comprises:

motion amount calculating means for calculating a motion amount using the original image and a one frame-delayed original image;

same gray level distribution detecting means for detecting a degree of a same gray level distribution for an original image;

minimal distribution lower and upper gray level re-determining means for re-determining the minimal distribution lower and upper gray levels using the motion amount and the same gray level distribution; and rearranging means for rearranging a gray level of the one frame-delayed original image using the minimal distribution lower and upper gray levels, wherein the minimal distribution lower and upper gray level re-determining means sets a first weight using the calculated motion amount, sets a second weight using the degree of the same gray level distribution, and re-determines the minimal distribution lower and upper gray levels using the first and second weights.

23. The driving device according to claim 22, wherein the minimal distribution lower and upper gray levels are determined by comparing a histogram distribution ratio calculated from the histogram with a preset critical value.

24. The driving device according to claim 22, wherein the gray level distribution of the original image is rearranged using gray levels existing between the minimal distribution lower and upper gray levels.

25. The driving device according to claim 22, wherein the motion amount is calculated by comparing similar points of the original image with the one frame-delayed original image.

26. The driving device according to claim 22, wherein the rearranging means includes:

moving image determining means for determining whether the one frame-delayed original image is a moving image using the motion amount; and expanding means for expanding a gray level range of the one frame-delayed original image using the gray levels existing between the minimal distribution lower and upper gray levels if it is determined that the one frame-delayed original image is the moving image.

27. The driving device according to claim 22, wherein the rearranging means comprises:

minimal distribution lower and upper gray levels determining means for determining whether the minimal distribution lower and upper gray levels should be reset using the motion amount; and expanding means for expanding a gray level range of the one frame-delayed original image using the gray levels existing between the determined minimal distribution lower and upper gray levels.

* * * * *